US006354584B1

(12) United States Patent
Suga et al.

(10) Patent No.: US 6,354,584 B1
(45) Date of Patent: Mar. 12, 2002

(54) SHEET FEEDING APPARATUS, IMAGE FORMING APPARATUS HAVING THE SAME AND IMAGE READING APPARATUS HAVING THE SAME

(75) Inventors: Takeshi Suga, Mishima; Takashi Yano, Shizuoka-ken, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/417,467

(22) Filed: Oct. 12, 1999

(30) Foreign Application Priority Data

Oct. 14, 1998 (JP) ..... 10-291961
May 13, 1999 (JP) ..... 11-132397

(51) Int. Cl.[7] ..... B65H 5/00

(52) U.S. Cl. ..... 271/10.12; 271/22; 271/127; 271/162

(58) Field of Search ..... 271/10.12, 22, 271/127, 162

(56) References Cited

U.S. PATENT DOCUMENTS

| | | | | |
|---|---|---|---|---|
| 5,016,866 A | | 5/1991 | Takahashi | 271/122 |
| 5,312,098 A | | 5/1994 | Inoue | 271/122 |
| 5,470,052 A | * | 11/1995 | Asakawa et al. | 271/118 X |
| 5,887,867 A | * | 3/1999 | Takahashi et al. | 271/117 X |
| 5,931,455 A | * | 8/1999 | Okui et al. | 271/127 |
| 5,984,297 A | | 11/1999 | Tanaka | 271/118 |

FOREIGN PATENT DOCUMENTS

| | | |
|---|---|---|
| DE | 33 34 522 A1 | 3/1984 |
| EP | 0 567 112 A1 | 10/1993 |
| EP | 0 754 637 A2 | 1/1997 |
| JP | 59-217538 | 12/1984 |
| JP | 1-32134 | 2/1985 |
| JP | 62-153027 | 7/1987 |
| JP | 64-2951 | 1/1989 |
| JP | 64-32134 | 2/1989 |
| JP | 1-162440 | 6/1989 |
| JP | 3-18532 | 1/1991 |
| JP | 5-32334 | 2/1993 |
| JP | 6-064769 | 3/1994 |
| JP | 7-17652 | 1/1995 |
| JP | 9-86705 | 3/1997 |
| JP | 09-226963 | 9/1997 |
| JP | 10-291691 | 11/1998 |

* cited by examiner

*Primary Examiner*—Christopher P. Ellis
*Assistant Examiner*—Kenneth W Bower
(74) *Attorney, Agent, or Firm*—Fitzpatrick, Cella, Harper & Scinto

(57) ABSTRACT

A sheet feeding apparatus comprising a movable sheet supporting device for supporting a sheet, a sheet feeding roller urged against the sheet supported by the sheet supporting device and adapted to rotate in a sheet feeding direction to feed the sheet, a separating roller opposed to the sheet feeding roller and adapted to rotate in a direction along which the sheet is restored to separate the sheet fed from the sheet feeding roller, a feeding device disposed at a downstream side of the sheet feeding roller in the sheet feeding direction and adapted to feed the sheet fed from the sheet feeding roller, and a pressing and retracting device for moving the sheet supporting device to bring the sheet supported by the sheet supporting device into presser contact with the sheet feeding roller and release the pressure contact, and wherein the sheet supporting device which places the sheet into pressure contact with the sheet feeding roller is moved by the pressing and retracting device to release the pressure contact between the sheet feeding roller and the sheet before a leading end of the sheet fed from the sheet supporting device reaches the feeding device.

14 Claims, 22 Drawing Sheets

INITIAL POSITION

INTERMEDIATE PLATE PRESSURE COMPLETE POSITION ($\beta$1 REVOLUTION)

PRE-FEED START POSITION ($\beta$2 REVOLUTION)

INTERMEDIATE PLATE PRESSURE
RELEASE COMPLETE POSITION
($\beta$3 REVOLUTION)

RE-FEED COMPLETE POSITION
(INITIAL POSITION)
(ONE REVOLUTION COMPLETION)

INITIAL STATE
(DRAW CLUTCH ON)

INTERMEDIATE PLATE 70
PRESSURE COMPLETION

FEED START

INTERMEDIATE PLATE 70 RELEASE COMPLETION

RE-FEED COMPLETION

REGISTRATION LOOP FORMATION COMPLETION

INITIAL POSITION

INTERMEDIATE PLATE PRESSURE COMPLETE POSITION ($\alpha$1 REVOLUTION)

SHEET FEEDING START AT SPEED V1 ($\alpha$2 REVOLUTION)

INTERMEDIATE PLATE PRESSURE RELEASE COMPLETE POSITION ($\alpha$3 REVOLUTION)

POSITION TO CHANGE INTO SHEET FEEDING SPEED V2 ($\alpha$4 REVOLUTION)

SHEET FEED COMPLETE POSITION (INITIAL POSITION) (ONE REVOLUTION COMPLETION)

INITIAL STATE

INTERMEDIATE PLATE 70
PRESSURE COMPLETION

SHEET FEDING START AT SHEET
FEEDING SPEED V1

INTERMEDIATE PLATE 70
RELEASE COMPLETION

CHANGE INTO SHEET FEEDING SPEED V2

RE-FEED COMPLETION

REGISTRATION LOOP FORMATION COMPLETION (DRAW CLUTCH STOP)

| | CONDITION | THE FIRST EARLIER TECHNOLOGY |
|---|---|---|
| EXPRESSION (1) | SHEET FEED CONDITION | Pb>0.633Ta−0.671Pa |
| EXPRESSION (2) | SEPARATION CONDITION | Pb<1.92Ta−2Pa |

| | CONDITION | THE FIRST EARLIER TECHNOLOGY |
|---|---|---|
| EXPRESSION (1) | SHEET FEED CONDITION | Pb>0.633Ta−0.671Pa |
| EXPRESSION (2) | SEPARATION CONDITION | Pb<1.43Ta−2Pa |

| | CONDITION | THE INVENTION |
|---|---|---|
| EXPRESSION (3) | SHEET FEED CONDITION | Pb>0.633Ta |
| EXPRESSION (4) | SEPARATION CONDITION | Pb<1.92Ta |

| | CONDITION | THE INVENTION |
|---|---|---|
| EXPRESSION (3) | SHEET FEED CONDITION | Pb>Ta |
| EXPRESSION (4) | SEPARATION CONDITION | Pb<1.43Ta |

SHEET FEEDING APPARATUS, IMAGE FORMING APPARATUS HAVING THE SAME AND IMAGE READING APPARATUS HAVING THE SAME

BACKGROUND OF THE INVENTION

1. Field of the Invention

The present invention relates to a sheet feeding apparatus used in an image forming apparatus such as a copying machine, a printer and the like or in an image reading apparatus such as a facsimile, a scanner and the like.

2. Related Background Art

In the past, for example, in a sheet feeding portion of a copying machine or the like, a sheet separation using a retard roller rotated in a direction opposite to a sheet feeding direction has mainly been used as sheet conveying means for preventing more than one sheet from being fed simultaneously (referred to as "double-feed" hereinafter).

Now, a conventional sheet feeding apparatus using a retard separation system will be briefly described.

FIG. 17 is a schematic side view of a sheet feeding apparatus of retard separation type comprising a sheet feeding roller (sheet pick-up roller) and a separating roller (refer to Japanese Patent Application Laid-open No. 3-18532, U.S. Pat. No. 5,016,866). This is referred to as a first earlier technology hereinafter.

As shown in FIG. 17, sheets S stacked on an intermediate plate 506 in a cassette 507 are lifted together with the intermediate plate 506 by a pressing arm 508 and a sheet pressing spring 505 to be always urged against a sheet feeding roller 501, thereby providing sheet feeding pressure.

Further, the sheet feeding roller 501 receives retard pressure from a separating roller 502. In this state, when the sheet feeding roller 501 is rotated in a sheet feeding direction, the sheet S urged against the sheet feeding roller 501 is picked up to reach a nip between the sheet feeding roller 501 and the separating roller 502. At this time, if a single sheet is pinched by the nip, the separating roller 502 is rotatingly driven in the sheet feeding direction by rotation of the sheet feeding roller 501 due to the presence of a torque limiter 503 formed integrally with a shaft of the separating roller, thereby feeding the sheet S.

However, if a plurality of sheets are pinched by the nip, the separating roller 502 is rotated with predetermined torque in a direction along which the double-fed sheets are returned, with the aid of the torque limiter 503, thereby preventing the sheet from being double-fed.

FIGS. 18 and 19 are schematic side views of a sheet feeding apparatus using a retard separation system constituted by a planetary gear mechanism (refer to Japanese Patent Publication No. 1-32134). This is referred to as a second earlier technology hereinafter.

As shown in FIG. 18, the sheet feeding apparatus utilizes a planetary gear mechanism comprising a sun gear 601, an intermediate gear 602, a planetary gear 603 and a connecting arm 604, and a sheet feeding roller 607 is connected to the planetary gear 603. Further, a separating roller 609 is connected to a drive shaft 606 through a torque limiter, and a pair of draw rollers 610 for feeding a sheet S at a speed higher than a speed at which the sheet feeding roller 607 feeds the sheets S is disposed at a downstream side of the sheet feeding roller 607 in a sheet feeding direction.

Now, an operation of the sheet feeding apparatus will be briefly described with reference to FIG. 19.

First of all, by rotating the drive shaft 606, the planetary gear 603 and the sheet feeding roller 607 are revolved in a direction indicated by the arrow A, with the result that the sheet feeding roller 607 abuts against an uppermost sheet S of a sheet stack contained within a sheet cassette. Further, in synchronism with such revolution, a lever 618 lifts an intermediate plate 623 on which the sheets are stacked toward the sheet feeding roller (in a direction indicated by the arrow G).

By this operation, the sheet S urged against the sheet feeding roller 607 is sent to a nip between the sheet feeding roller 607 and the separating roller 609, thereby effecting separation and feeding of the sheet. Further, the sheet S left the nip enters into the pair of draw rollers 610, and the planetary gear mechanism and the sheet feeding roller 607 are returned to their original positions by transmitting a driving force of the pair of draw rollers 610 to the planetary gear mechanism through the sheet S. And, such operation is repeated.

Although two earlier technologies in the sheet feeding mechanism are shown, it is considered that such technologies can be improved in several points.

First, in the mechanism according to the first earlier technology, the sheets S stacked on the intermediate plate 506 within the cassette 507 are lifted together with the intermediate plate 506 by the sheet pressing spring 505 to be always urged against the sheet feeding roller 501. Thus, a sheet feed/separation condition greatly depends upon the pressure of the intermediate plate, with the result that an optimum sheet feeding area is limited in consideration of the pressure of the intermediate plate as a function.

In particular, since the pressures of the intermediate plate generated by the sheet pressing spring 505 vary with the number of sheets stacked within the cassette 507, the sheet feed/separation condition differs between a case where the cassette 507 is loaded up with the sheets and a case where a several number of sheets are stacked. Further, since the sheet S is always urged against the sheet feeding roller 501, the pressure of the intermediate plate always acts on the stacked sheets S. Thus, while the uppermost sheet S is being fed, a next or succeeding sheet S' is subjected to a feeding force due to friction between the sheets, with result that double-feeding of sheet S' will easily occur.

In addition, even if the double-fed sheets are separated and tried to be restored, the sheets are pinched between the sheet feeding roller 501 and the intermediate plate 506 so that the double-fed sheets may not be restored smoothly.

Further, an allowable range of the appropriate sheet feed area is further limited in dependence upon the kind of sheet (for example, a sheet having a great coefficient of friction) and reduction of coefficients of friction of the sheet feeding roller and the separating roller due to wear of the sheet feeding roller and the separating roller, thereby worsening the stability.

Therefore, it is hard to say that this mechanism is a sheet feeding mechanism having high stability and high reliability.

Incidentally, in this mechanism, if it is tried that the double-feeding is unlikely to occur and the double-fed sheets can easily be restored, the restoring force provided by the torque limiter 503 must be set to a greater value or the retard force of the retard spring must be decreased considerably or the feeding pressure provided by the sheet pressing spring 505 must be decreased considerably.

However, in many cases, slippage between the sheet feeding roller 501 and the sheet and/or between the separating roller 502 and the sheet may easily be generated, with the result that the wear of the sheet feeding roller 501 and the separating roller 502 is accelerated, thereby reducing the service life of the sheet feeding roller 501 and the separating roller 502 greatly. As a result, the number of periodical replacing operations for worn parts is increased to increase the maintenance cost of the apparatus. Further, a torque of a driving force applying means (motor) must be increased, thereby making the apparatus expensive and increasing power consumption.

Further, when the restoring force of the torque limiter 503 is set to a greater value, in a space Z formed between a nip X (between the sheet feeding roller 501 and the separating roller 502) and an abutment area between the sheet feeding roller 501 and the intermediate plate 506, it is considered that the double-fed sheet (particularly, thin sheet having poor rigidity) may be buckled, thereby causing sheet jamming.

In addition, when a pair of feeding rollers are provided at a downstream side of the sheet feeding roller 501 and the separating roller 502 in the sheet feeding direction, the pair of feeding rollers must draw the sheet S (always pressurized) from the intermediate plate 506 and the nip between the sheet feeding roller 501 and the separating roller 502, with the result that greater load will act on the pair of feeding rollers, thereby shortening the service life of the pair of feeding rollers.

Furthermore, since the intermediate plate 506 is always urged against the sheet feeding roller 501 by the sheet pressing spring 505, if this conventional technology is applied to a manual sheet feeding portion, when the operator sets the sheets, he must press the intermediate plate 506 down against the sheet pressing spring 505 to create a gap between the intermediate plate 506 and the sheet feeding roller 501 and insert the sheets into the gap.

This results in poor operability, so that operator's sheet setting failure may easily occur, which would lead to sheet jamming and skewed feeding.

Next, in the mechanism according to the second earlier technology, the sheet feeding roller 607 is urged against and separated (retracted) from the stacked sheets S so that the intermediate plate 623 is pivotally moved by the lever 618 in upward and downward directions accordingly, thereby effecting pressurizing and releasing operations with respect to the sheet feeding roller 607. Namely, when the sheets S stacked on the intermediate plate 623 are fed, the sheets S are pinched by the sheet feeding roller 607 and the intermediate plate 623 from above and below.

Further, the retracting operation of the sheet feeding roller 607 and the lowering operation of the lower 618 are effected by utilizing the feeding force obtained when the fed sheet S are pinched between the pair of draw rollers 610. Accordingly, the stacked sheets S are pinched between the sheet feeding roller 607 and the intermediate plate 623 until a leading end of the fed sheet S reaches the nip of the pair of draw rollers 610.

Since the sheet feeding roller 607 is urged against the sheets S during the separating operation, the sheets are difficult to be separated, and, further, since the leading end of the sheet S reaches the nip of the pair of draw rollers 610 during such urging, there is no timing for restoring the double-fed sheets.

In consideration of the sheet feed/separation condition, the sheet feeding mechanism according to the second earlier technology is the same as the sheet feeding mechanism according to the first earlier technology. Thus, as is in the first earlier technology, in this mechanism, since the appropriate sheet feed area is narrow, it is hard to say that it has high stability and high reliability. Further, the construction is very complicated and the number of parts is great.

Further, since the releasing of the pressure of the sheet feeding roller 607 against the sheet S and the revolving operation of the planetary gear mechanism and the sheet feeding roller 607 are effected by the feeding force of the pair of draw rollers 610, great feeding load acts on the pair of draw rollers, thereby reducing the service life of the draw rollers.

As a problem common to the above two earlier technologies, there is a problem that stability and reliability of sheet feeding and separating operations cannot be maintained adequately because the pressure of the intermediate plate affects an influence upon the sheet feeding/separation condition. Further, during the separating operation, since the sheets stacked on the intermediate plate are urged against the sheet feeding roller, double-feeding occurs easily and there is no timing for restoring the double-fed sheets, and, in dependence upon the kind of sheet, the sheet may be buckled to cause sheet jamming.

SUMMARY OF THE INVENTION

The present invention aims to eliminate the above-mentioned conventional drawbacks, and an object of the present invention is to ensure sheet feeding and separating operations, to improve stability and reliability of a sheet feeding apparatus, to reduce a maintenance cost of the apparatus and to make the apparatus simpler and inexpensive.

According to the present invention, there is provided a sheet feeding apparatus comprising movable sheet supporting means for supporting a sheet, a sheet feeding roller to be urged against the sheet supported by the sheet supporting means to rotate in a sheet feeding direction to feed the sheet, a separating roller opposed to the sheet feeding roller to rotate in a sheet restoring direction to separate the sheet fed from the sheet a roller, feeding means disposed at a downstream side of the sheet feeding roller in the sheet feeding direction to convey the sheet fed from the sheet feeding roller, and pressing and a retracting means for moving the sheet supporting means to bring the sheet supported by the sheet supporting means into pressure contact with the sheet feeding roller and release the pressure contact, and wherein the sheet supporting means which places the sheet into pressure contact with the sheet feeding roller is moved by the pressing and retracting means to release the pressure contact between the sheet feeding roller and the sheet before a leading end of the sheet fed from the sheet supporting means reaches the conveying means.

DESCRIPTION OF THE PREFERRED EMBODIMENTS

Now, a sheet feeding apparatus according to the present invention will be fully described.

Figure 1:
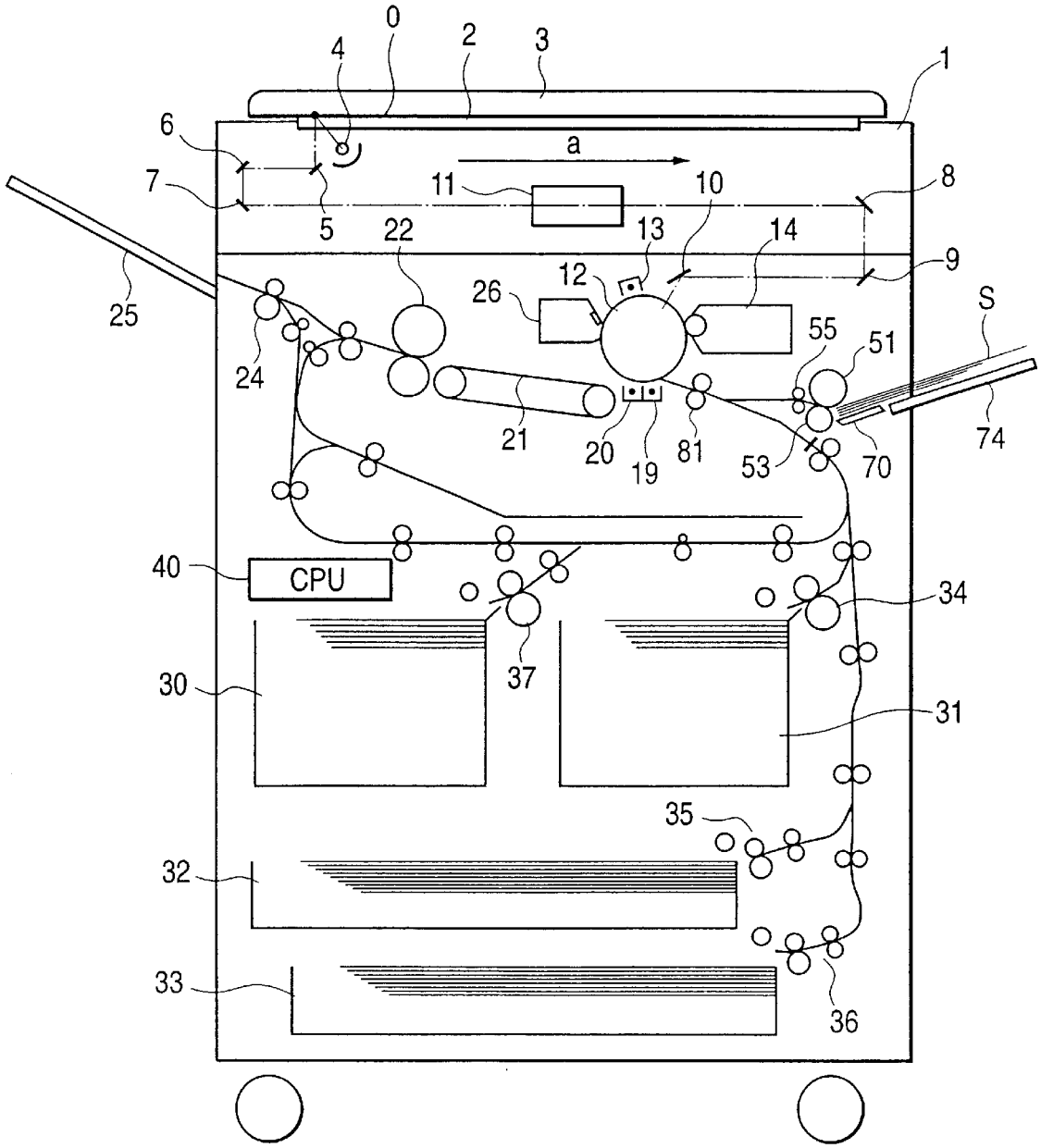
FIG. 1 is a schematic sectional view of a copying machine having a sheet feeding apparatus according to the present invention.

First of all, an image forming apparatus having a sheet feeding apparatus according to the present invention will be briefly explained. FIG. 1 is a schematic sectional view of a copying machine as an image forming apparatus. In FIG. 1, an original glass plate 2 formed from a transparent glass plate is secured to an upper part of a main body 1 of the copying machine. An original pressure cover 3 serves to press and fix an original 0 rested on the original glass plate 2 at a predetermined position thereof with an imaged surface facing downwardly.

Below the original glass plate 2, there is provided an optical system comprising a lamp 4 for illuminating the original 0, reflection mirrors 5, 6, 7, 8, 9, 10 for directing a light image of the illuminated original 0 to a photosensitive drum 12, and an imaging lens 11 for imaging the light image. Incidentally, the lamp 4 and the reflection mirrors 4, 5, 6, 7 are moved at a predetermined speed in a direction indicated by the arrow a to scan the original 0.

As sheet feeding portions, there are provided cassette sheet feeding portions 34, 35, 36, 37 for feeding sheets stacked in sheet cassettes 30, 31, 32, 33 contained within the main body 1 of the copying machine to an image forming portion, a sheet feeding portion 51, 53, 55, 70 (referred to as "multisheet feeding portion" hereinafter) for continuously feeding sheets having various materials and sizes from a sheet feeding tray 74 to the image forming portion.

The image forming portion includes the photosensitive drum 12, a charger 13 for uniformly charging a surface of the photosensitive drum 12, a developing unit 14 for forming a toner image to be transferred to the sheet S, by developing an electrostatic latent image formed by the light image illuminated on the surface of the photosensitive drum 12 charged by the charger 13 from the optical system, a transfer charger 19 for transferring the toner image developed on the surface of the photosensitive drum 12 onto the sheet S, a separation charger 20 for separating the sheet S to which the toner image is transferred from the photosensitive drum 12, and a cleaner 26 for removing residual toner from the photosensitive drum 12 after transferring the toner image.

At a downstream side of the image forming portion, there are provided a transporting portion 21 for transporting the sheet S to which the toner image is transferred, and a fixing unit 22 for fixing the image on the sheet S transported by the transporting portion 21 as a permanent image. Further, there are provided discharge rollers 24 for discharging the sheet S to which the image is fixed by the fixing unit 22 out of the main body 1 of the copying machine, and a discharge tray 25 for receiving the sheet S discharged by the discharge rollers 24 is also provided outside of the main body 1 of the copying machine.

Next, the multisheet feeding portion of the image forming apparatus according to an embodiment of the present invention will be fully explained.

Figure 2:
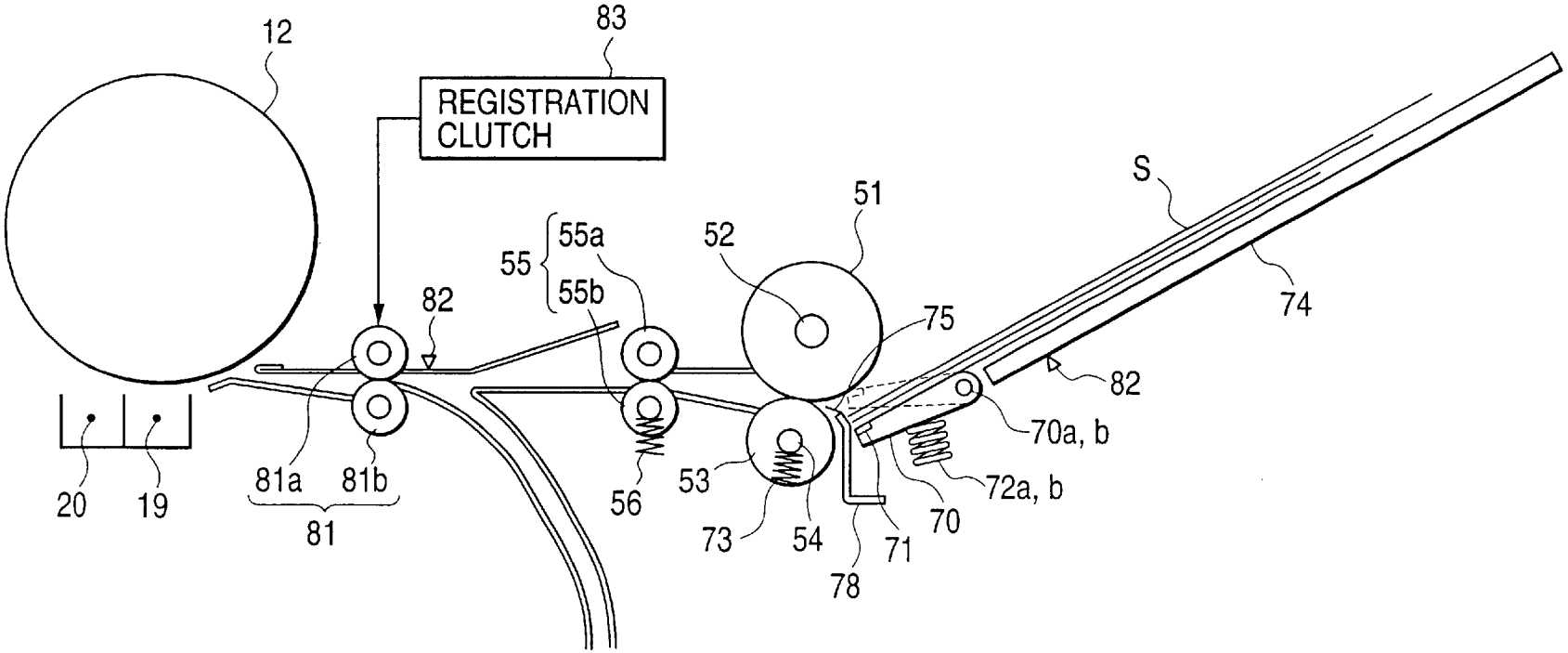
FIG. 2 is a sectional view of a sheet feeding apparatus according to an embodiment of the present invention.
Figure 3:
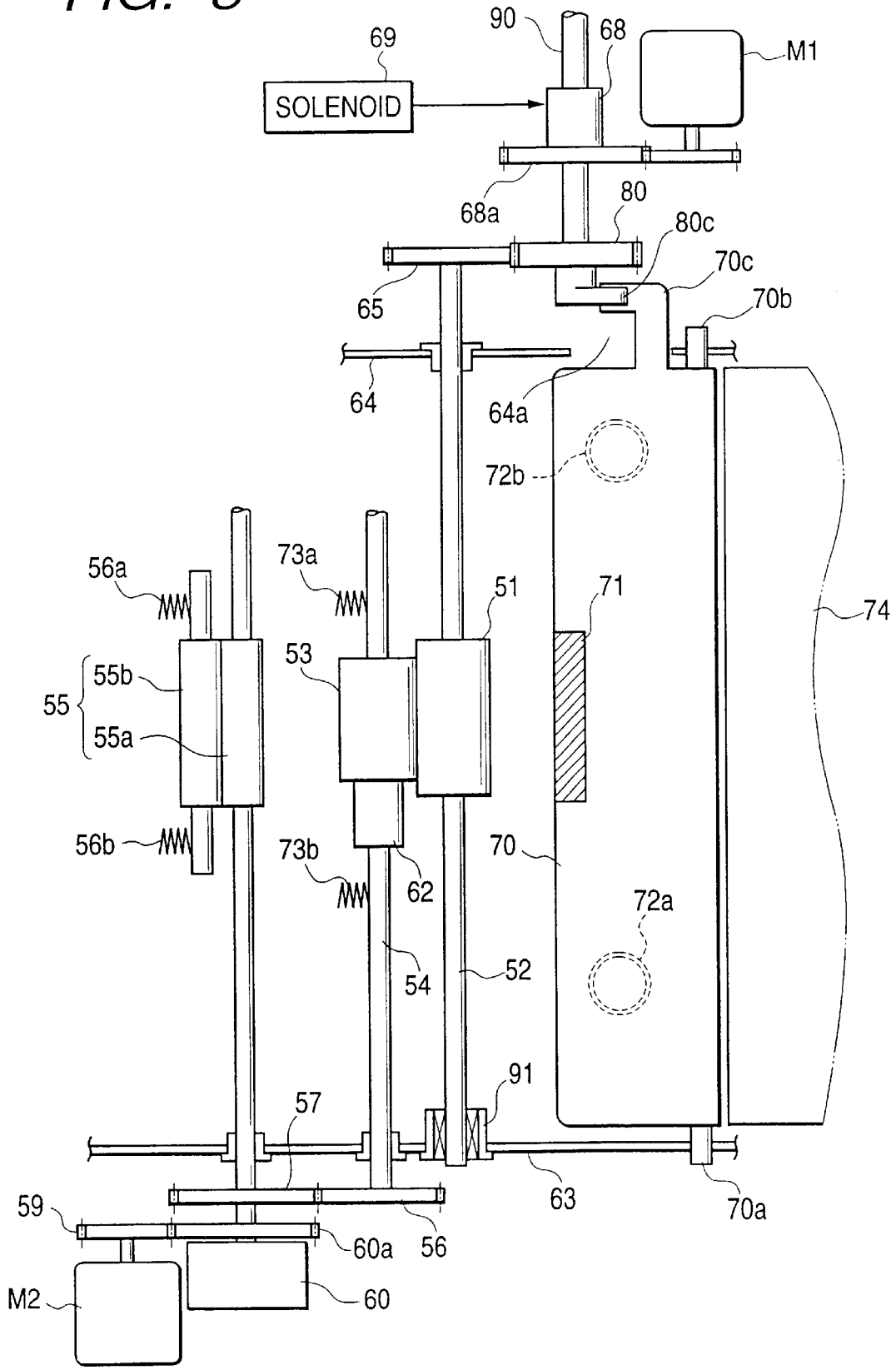
FIG. 3 is a drive development view (plan view) of a sheet feeding apparatus.

FIG. 2 is a sectional view showing the multisheet feeding portion and a drum portion, and FIG. 3 is a drive development view (plan view) of the multisheet feeding portion. The main body 1 of the copying machine is provided with a multisheet feeding tray 74 for stacking and supporting a sheet bundle S. The multisheet feeding tray 74 is provided with a sheet detecting sensor 82 comprising a photo-interrupter or the like for detecting pressure/absence of the sheet S on the tray 74.

An intermediate plate (sheet supporting means) 70 is pivotally movable around fulcrums 70*a*, 70*b* with respect to front and rear side plates 63, 64 and is biased toward a clockwise direction (FIG. 2) (direction along which the intermediate plate is urged against a sheet feeding roller 51) by compression springs (pressing and retracting means) 72*a*, 72*b* so that the sheet supported by the intermediate plate can be brought into pressure contact with the sheet feeding roller 51 as sheet conveying means (as shown by the broken line in FIG. 2) and released from the pressure contact (as shown by the solid line in FIG. 2) by a pressing and retracting portion which will be described later.

Further, a felt 71 for preventing double-feed of sheets S and for relieving shock on pressing the intermediate plate 70 against the sheet feeding roller 51 is provided on an abutment portion (against the sheet feeding roller 51) of a distal end of the intermediate plate 70. The sheet feeding roller 51 is secured to a sheet feeding roller support shaft 52, and the support shaft 52 is rotatably supported by the front and rear side plates 63, 64 in such a manner that the sheet feeding roller 51 is not rotated reversely (in an counter-clockwise direction in FIG. 2) by the action of a one-way clutch 91 disposed between the front side plate 63 and the support shaft 52.

Further, a sheet feeding drive gear (drive transmitting means) 65 is secured to a rear end of the support shaft 52. A control gear (drive transmitting means) 80 engageable with the sheet feeding drive gear 65 and having a toothless portion 80a opposed to the sheet feeding drive gear 65.

Further, a cam (pressing and retracting means) 80*c* for bringing the sheets supported by the intermediate plate 70 into pressure contact with the sheet feeding roller 51 and releasing the pressure contact is integrally formed with the control gear 80.

A cam follower (pressing and retracting means) 70*c* is integrally formed on a rear end of the intermediate plate 70. The cam follower 70*c* extends up to the cam 80*c* through a hole 64*a* formed in the rear side plate 64 to engage with the cam 80*c* so that the clockwise rotation (FIG. 2) of the intermediate plate 70 is regulated.

Further, the control gear 80 is secured to a drive shaft 90 having a spring clutch 68. One revolution of the spring clutch 68 is controlled by turning ON a control solenoid 69 for the spring clutch 68 by a time of T1 (sec). The phase angles of the spring clutch 68 and the toothless portion 80*a* are selected so that the toothless portion 80*a* of the control gear 80 is normally opposed to the sheet feeding drive gear 65.

With this arrangement, in an initial state, the sheet feeding drive gear 65, the support shaft 52 and the sheet feeding roller 51 can be rotated in a sheet feeding direction with no load.

A pair of draw rollers (conveying means) 55 are disposed at a downstream side of the sheet feeding roller 51 in the sheet feeding direction. A drive shaft of the drive draw roller 55*a* is rotatably supported by the front and rear side plates 63, 64 via bearings (not shown), and an electromagnetic clutch 60 is provided on an end of the drive shaft so that a driving force from a draw motor M2 can be connected to and disconnected from the drive shaft via gears 59, 60*a*.

The driven draw roller 55*b* is urged against the drive draw roller 55*a* via bearings (not shown) by springs 56*a*, 56*b*. Further, a gear 57 is secured to the drive shaft of the drive draw roller 55*a* so that a driving force can be transmitted to a drive shaft 54 of a separating roller via a gear 56.

Incidentally, since the gears 57, 56 are secured to the drive shaft of the drive draw roller 55*a* and the drive shaft 54 of a separating roller 53, respectively, the pair of draw rollers 55 are rotated in synchronism with the drive shaft 54 of the separating roller 53. Further, the gears 57, 56 are selected so that the drive draw roller 55*a* is rotated in the sheet feeding direction (clockwise direction in FIG. 2) and the drive shaft 54 of the separating roller 53 is rotated in a direction opposite to the sheet feeding direction (clokwise direction in FIG. 2).

Namely, when the electromagnetic clutch 60 is turned ON, the driving force of the draw motor M2 is transmitted, with the result that the drive draw roller 55*a* is rotated in the sheet feeding direction and at the same time the drive shaft 54 of the separating roller 53 is rotated in the direction opposite to the sheet feeding direction.

Further, the separating roller 53 is rotatably supported on the drive shaft 54 via a torque limiter 62 for generating predetermined torque. The separating roller 53 is opposed to the sheet feeding roller 51 and is urged against the sheet feeding roller 51 with predetermined retard pressure by springs 73*a*, 73*b* via bearings (not shown).

Incidentally, a torque value of the torque limiter 62 and retard pressure of the separating roller 53 provided by the springs 73*a*, 73*b* are selected so that, in a stage that only a single sheet exists in a nip between the sheet feeding roller 51 and the separating roller 53 or a state that there is no sheet, the separating roller 53 follows the sheet feeding roller 51 by a friction force (also, the separating roller is stopped when the sheet feeding roller 51 is stopped) and, only when two or more sheets exist in the nip, the separating roller 53 is rotated reversely to generate a restoring force.

Further, an abutment plate 78 against which the sheets abut when the operator sets the sheets on the sheet feeding tray is secured between the separating roller 53 and the intermediate plate 70. A guide 75 formed from a thin plate made of polyethylene or SUS and adapted to guide a leading end of the sheet to the nip between the sheet feeding roller 51 and the separating roller 53 is provided on a distal end of the abutment plate 78. With this arrangement, the leading end of the sheet is prevented from abutting against the separating roller 53 to prevent the leading end of the sheet from being wound or bent.

Next, the drive transmitting means and the pressing and retracting means for the sheet feeding roller 51 and the intermediate plate 70 will be fully explained.

As mentioned above, at the engagement position of the sheet feeding drive gear 65, there is provided the control gear 80 formed integrally with a gear portion 80*d* engageable with the sheet feeding drive gear 65, a toothless portion 80*a*, and a cam 80*c* through which the intermediate plate 70 is urged against and retracted from the sheet feeding roller 51. As mentioned above, one revolution of the control gear 80 can be controlled by the spring clutch 68 and the solenoid 69. Incidentally, since the construction of the spring clutch 68 does not relate to the present invention, a detailed explanation thereof will be omitted.

Since the phase angle of the spring clutch 68 and the configuration and position of the toothless portion 80*a* are selected so that the toothless portion 80*a* of the control gear 80 is opposed to the sheet feeding drive gear 65 in the initial state, although the sheet feeding roller support shaft 52 can be rotated, the rotation of the support shaft 52 in the direction opposite to the sheet feeding direction is regulated by the one-way clutch 91.

Further, the cam 80*c* abuts against the cam follower 70*c* provided at the end of the intermediate plate 70, and the configuration of the cam 80*c* and the phase angle of the toothless portion 80*a* with the cam 80*c* are selected so that the intermediate plate 70 is retracted from the sheet feeding roller 51 against the compression springs 72*a*, 72*b* in the initial state. Thus, when the operator sets the sheet bundle, since the intermediate plate 70 is retracted from the sheet feeding roller 51 so that the pressure between the intermediate plate 70 and the sheet feeding roller 51 is released, the sheet bundle can easily be inserted until it abuts against the abutment plate 78.

Next, the sheet feeding operation and the separating operation effected by the drive transmitting means and the pressing and retracting means will be explained.

Figure 4A:
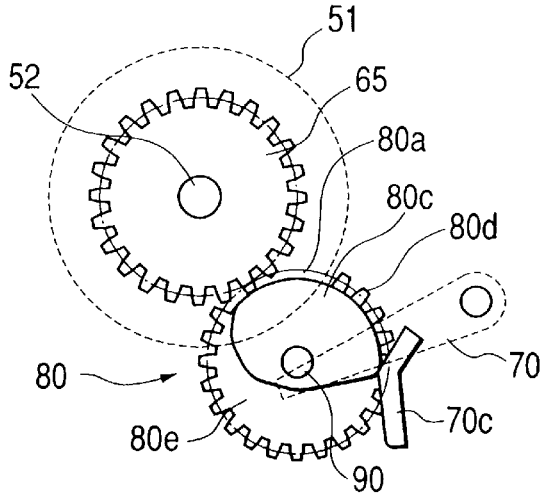
FIGS. 4A, 4B, 4C, 4D and 4E are views showing an operation of a control gear in an embodiment of the present invention.
Figure 4B:
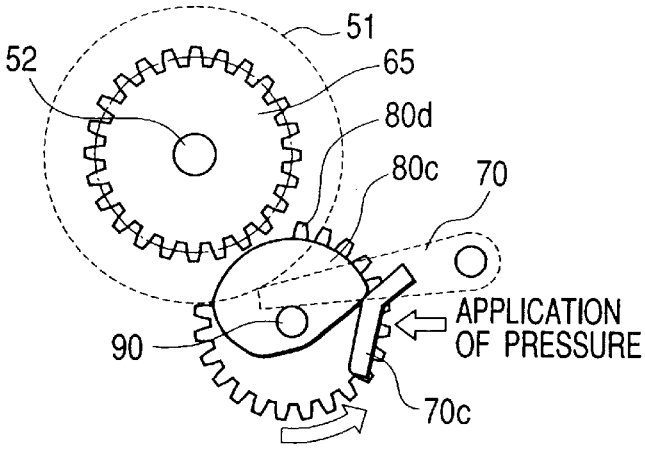
Figure 5A:
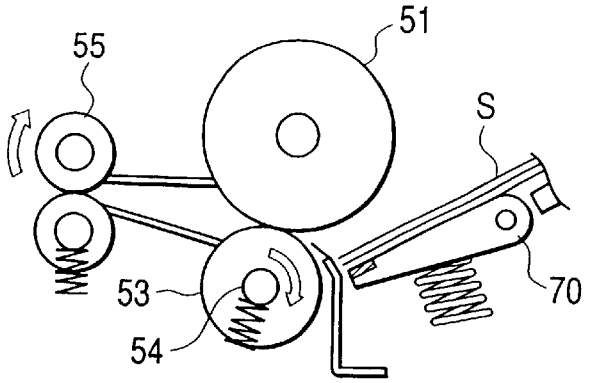
FIGS. 5A, 5B, 5C, 5D, 5E and 5F are views showing operations of a roller and an intermediate plate in an embodiment of the present invention.
Figure 5B:
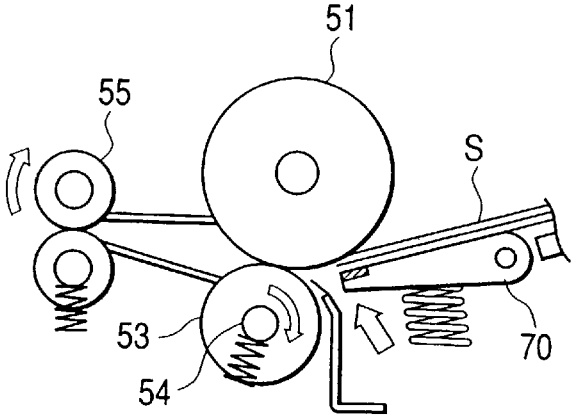

When the solenoid 69 is turned ON by the time of T1 (sec), under the action of the spring clutch 68, the control gear 80 starts to rotate. The control gear 80 is rotated in an counter-clockwise direction in FIG. 4A to rotate the cam 80*c* from an intermediate plate retracting position to an intermediate plate pressing position β1. During this rotation, the cam 80*c* is separated from the cam follower 70*c*, with the result that the intermediate plate 70 is moved to be urged against the sheet feeding roller 51. As a result, an uppermost sheet S in the sheet bundle rested on the sheet feeding tray 74 is brought into pressure contact with the sheet feeding roller 51 (FIGS. 4B and 5B).

Figure 4C:
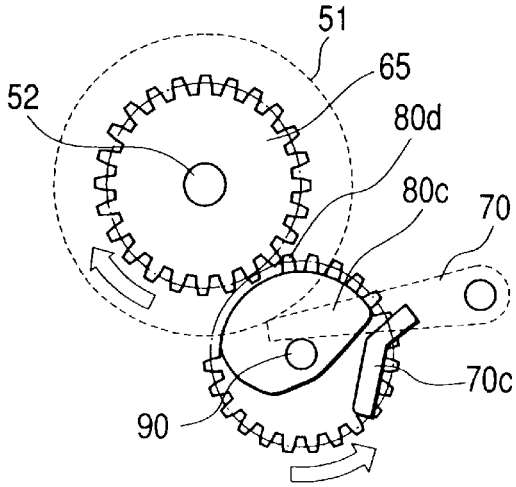
Figure 5C:
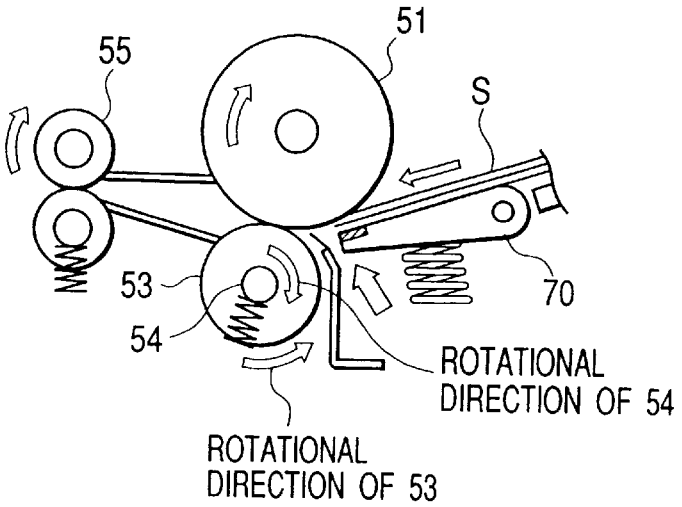

When the control gear 80 is further rotated up to a position β2, the gear portion 80*d* of the control gear 80 is engaged by the sheet feeding drive gear 65, thereby starting the sheet feeding drive gear 65 to rotate. In response to this rotation, the sheet feeding roller 51 is rotated to feed out the uppermost sheet S in the sheet bundle rested on the intermediate plate 70 (FIGS. 4C and 5C).

When the sheet feeding operation is continued and the control gear 80 is rotated up to a position β3, the leading end of the fed sheet S reaches a position spaced apart from the nip between the sheet feeding roller 51 and the separating roller 53 by a distance L1. This sheet feeding amount L1 is selected to become greater than a distance La from the sheet abutment portion 78 to the nip between the sheet feeding roller 51 and the separating roller 53 and smaller than a distance Lb from the nip to the pair of draw rollers 55.

Further, the rotating speed of the sheet feeding drive gear 65 at this time is selected by determining the rotating speed of the sheet feeding motor M1 and the number of teeth of the gears and diameters of rollers so that the sheet feeding speed of the sheet feeding roller 51 becomes equal to the feeding speeds of the pair of draw rollers 55 and a pair of registration rollers 81.

Figure 4D:
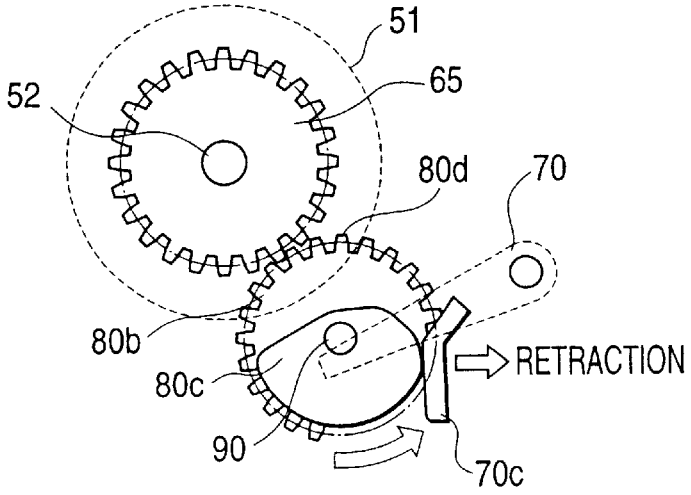
Figure 5D:
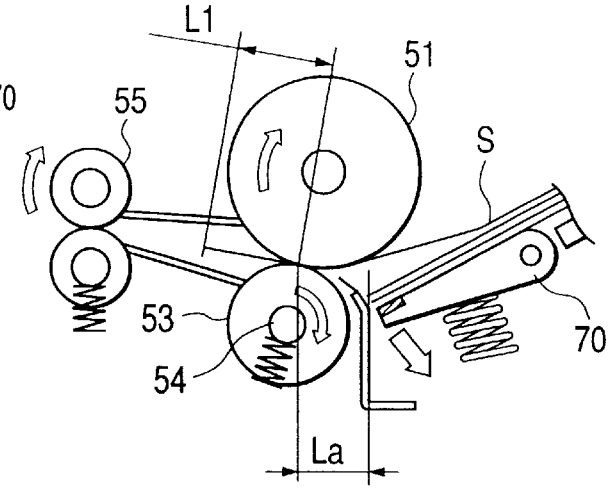

Further, the phase angles of the control gear 80 and the cam 80*c* are selected so that the cam 80*c* is restored to the intermediate plate retracting position when the control gear 80 is rotated up to the position β3. With this arrangement, by rotating the control gear 80 to the position β3, the sheet S fed from the intermediate plate 70 is fed by the predetermined amount L1, and, at the same time, the sheet bundle on the intermediate plate 70 placed into pressure contact with the sheet feeding roller 51 is spaced apart from the sheet feeding roller 51 by lowering the intermediate plate 70 by the engagement between the cam 80*c* and the cam follower 70*c* of the intermediate plate 70 (FIGS. 4D and 5D).

When the pressure of the intermediate plate 70 against the sheet feeding roller 51 is released, even if double-feeding occurred, the intermediate plate 70 is not urged against the sheet feeding roller 51, thus, the double-fed sheet(s) can surely be restored onto the intermediate plate 70 by the separating roller 53.

The control gear 80 is further rotated, so that the sheet is fed by the sheet feeding roller 51.

Incidentally, a feeding amount L2 of the sheet feeding roller 51 at this time is selected by setting the number of teeth of the control gear 80 so that the leading end of the sheet S fed in front of the pair of draw rollers 55 before the pressure release of the intermediate plate 70 is surely received by the pair of draw rollers 55 and does not reach the pair of registration rollers 81.

Figure 4E:
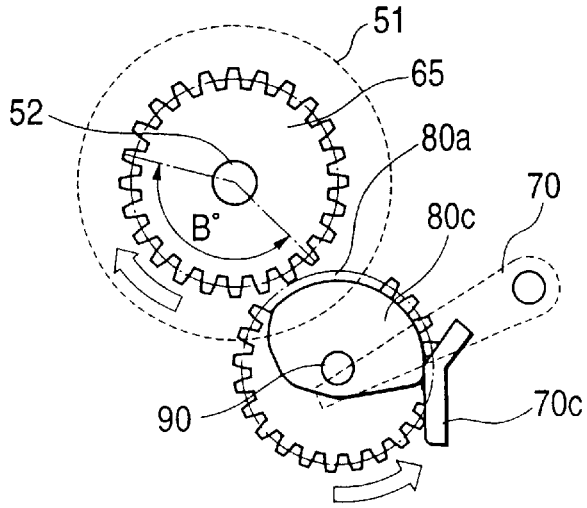
Figure 5E:
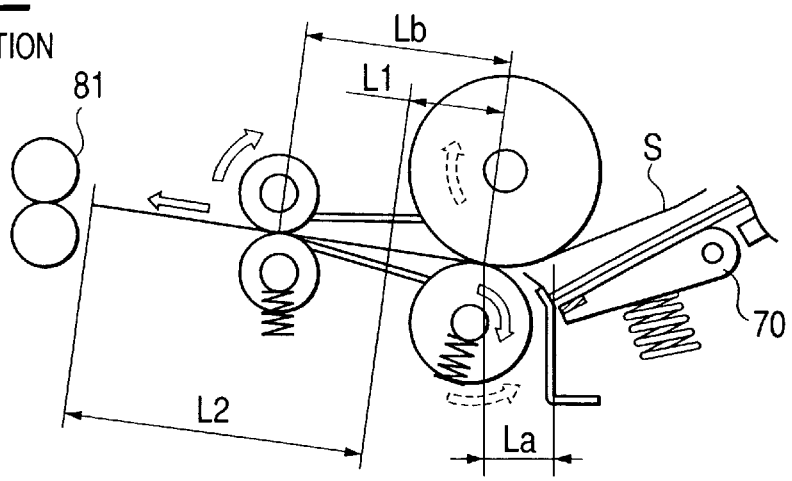
Figure 5F:
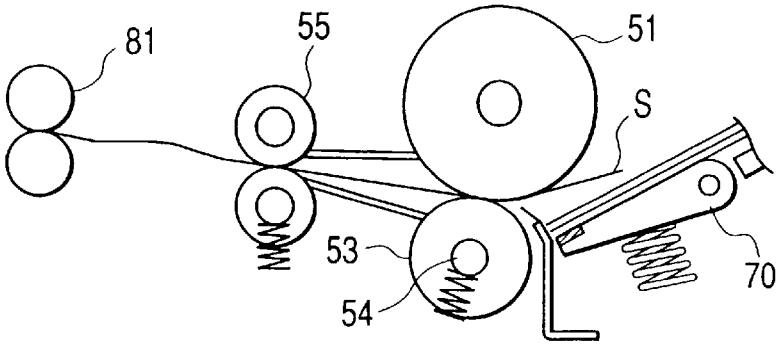

Further, when the rotation of the control gear 80 is continued to bring the toothless portion 80*a* to the position opposite to the sheet feeding drive gear 65, the driving force is not transmitted to the sheet feeding drive gear 65, thereby stopping the sheet feeding roller 51. The rotation of the control gear 80 is finished and the control gear 80 is stopped at the initial position (FIGS. 4E and 5E).

Figure 6:
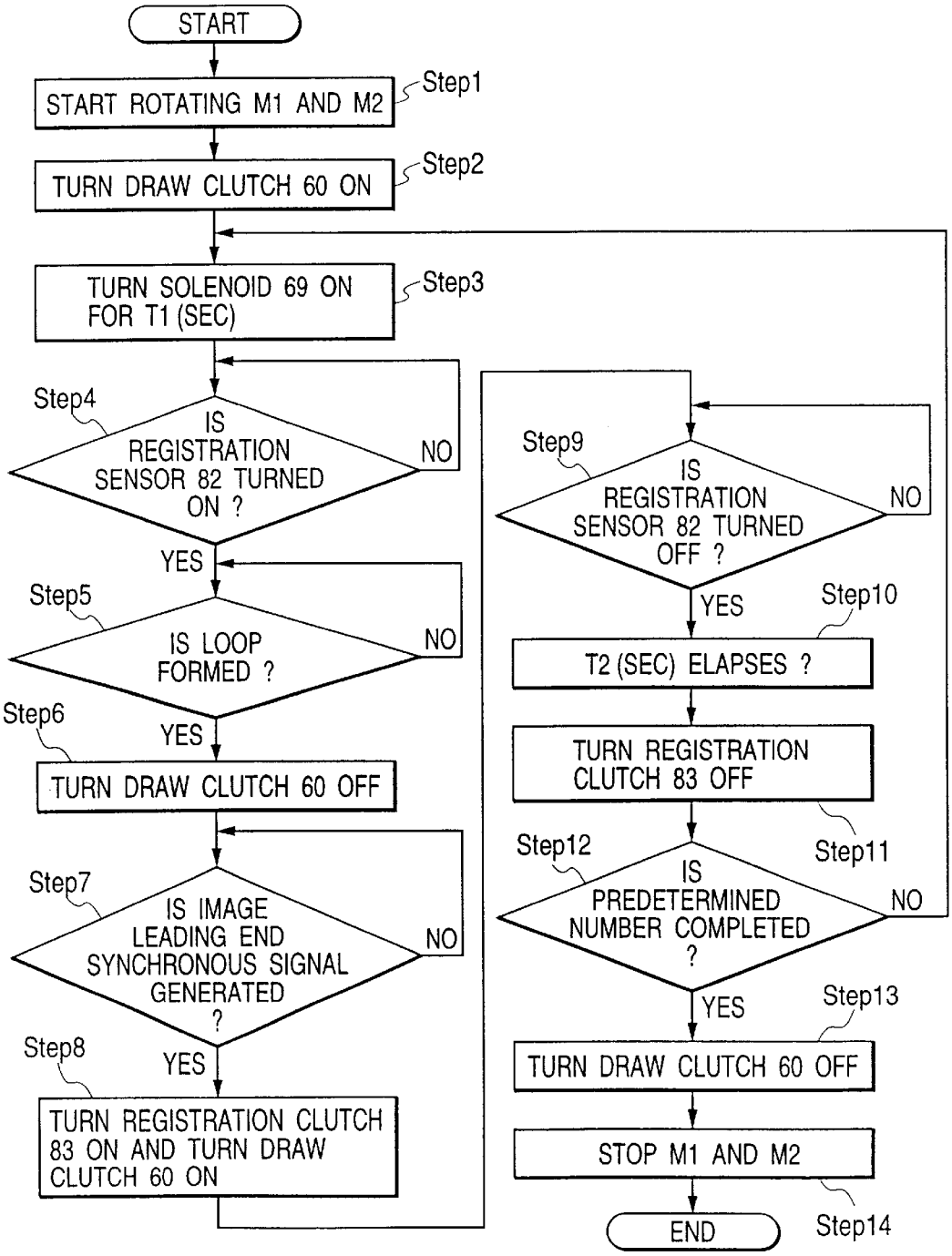
FIG. 6 is a flowchart showing a sheet feeding operation in an embodiment of the present invention.
Figure 7:
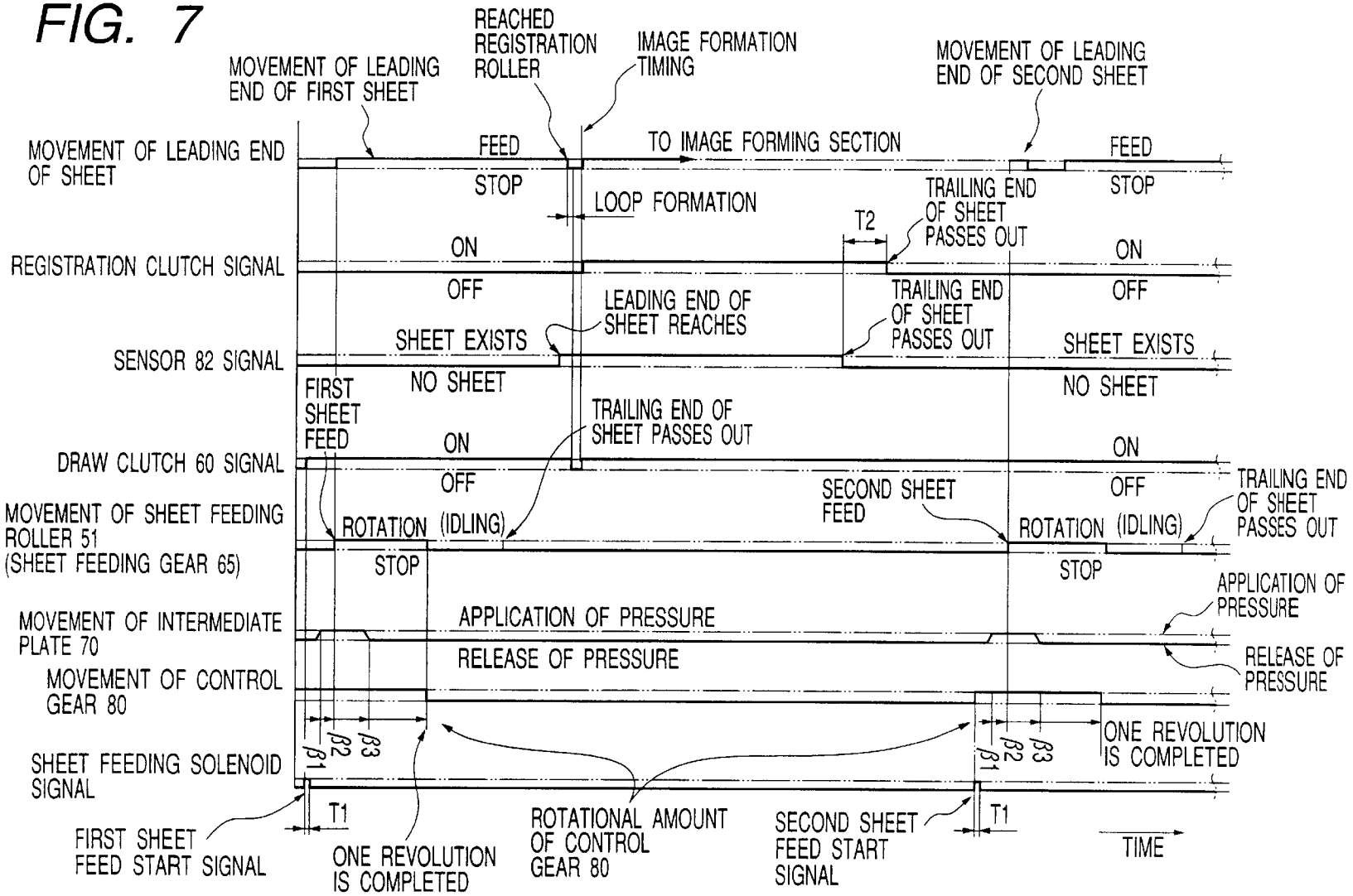
FIG. 7 is a timing chart showing a sheet feeding operation in an embodiment of the present invention.

Next, the sheet feeding operation using the multisheet feeding portion will be explained with reference to a flowchart shown in FIG. 6 and a timing chart shown in FIG. 7.

In a state in which the sheet bundle is rested on the sheet feeding tray 74, when a start button (not shown) is depressed, the draw motor M2 and the sheet feeding motor M1 start to rotate (step 1), and an ON signal of the draw clutch 60 is emitted from a CPU 40 (step 2).

As a result, as mentioned above, the pair of draw rollers 55 start to rotate in the sheet feeding direction and the drive shaft 54 of the separating roller 53 is rotated in the direction opposite to the sheet feeding direction, and the predetermined restoring force is generated in the separating roller 53 by torque generated by the torque limiter 62. However, the separation roller 53 is still maintained in the stopped state by the friction force between the separating roller 53 and the sheet feeding roller 51 rotation of which is regulated by the action of the one-way clutch 91.

Then, after a predetermined time period is elapsed, the solenoid 69 is turned ON by a time period T1 (sec) on the basis of a signal from the CPU 40 (step 3) to start control of one revolution of the control gear 80. By this operation, as mentioned above, first of all, the sheet bundle on the intermediate plate 70 abuts against the sheet feeding roller 51. Then, the sheet feeding roller 51 is rotated to feed out the uppermost sheet S in the sheet bundle rested on the tray 74 by the pressing force of the intermediate plate 70 and the friction force between the sheet and the sheet feeding roller 51.

Incidentally, the separation roller 53 is driven in the sheet feeding direction by the rotation of the sheet feeding roller 51. By the way, in the above-mentioned sheet feeding operation, if two or more sheets are fed in an overlapped state (i.e., if double-feed occurs), the separating roller 53 acts to restore the double-fed sheet(s). At this time, however, since the intermediate plate 70 urges the sheet feeding roller 51 via the intermediate plate spring 72, the separating operation of the separating roller 53 may be obstructed not to restore the double-fed sheet(s).

However, when the control gear 80 is further rotated, the sheets on the intermediate plate 70 are released from the pressure of the sheet feeding roller 51 by the action of the cam 80*c* and the cam follower 70*c*. At this time, since the turned-ON state of the draw clutch 60 is maintained, the drive shaft 54 of the separating roller 53 continues to rotate in the direction opposite to the sheet feeding direction, and the restraint of the double-fed sheet(s) is released due to the pressure release.

At this point, the separating roller 53 starts to rotate in the restoring direction until the double-fed sheet(s) caused by the above sheet feeding operation do not exist in the nip between the sheet feeding roller 51 and the separating roller 53, thereby certainly avoiding double-feeding. Incidentally, in the state in which only a single sheet is pinched by the nip between the sheet feeding roller 51 and the separating roller 53, the sheet feeding roller 51, the separating roller 53 and the sheet S can be maintained in the stationary state by the action of the one-way clutch 91 and the friction forces between the sheet S and the sheet feeding roller 51 and between the sheet S and the separating roller 53.

When the control gear 80 is further rotated, the leading end of the sheet S is received by the pair of draw rollers 55. After the sheet is fed by the sheet feeding roller 51 by the predetermined distance L2, one revolution of the control gear 80 is completed to stop the sheet feeding roller 51. However, since the pair of draw rollers 55 continue to rotate, the sheet S is fed up to the pair of registration rollers 81.

At this time, since the toothless portion 80*a* of the control gear 80 is opposed to the sheet feeding drive gear 65, any load does not act on the sheet feeding roller 51. Thus, the sheet feeding roller 51 is subjected to the rotational force from the sheet S fed by the pair of draw rollers 55, with the result that the sheet feeding roller 51 is rotatingly driven (idle rotation) until a trailing end of the sheet S leaves the nip between the sheet feeding roller 51 and the separating roller 53.

Incidentally, in this drawing operation, since the intermediate plate 70 is retracted from the sheet feeding roller 51, a succeeding sheet is not subjected to a friction force from the sheet S being drawn. Thus, the succeeding sheet is unlikely to be double-fed. However, if the succeeding sheet S should be double-fed, during the operation of the pair of draw rollers 55, since the drive shaft 54 of the separating roller 53 is rotated in the direction opposite to the sheet feeding direction and the intermediate plate 70 is retracted from the sheet feeding roller 51 to release the pressure contact at that point, the separating roller 53 starts to rotate reversely to restore the double-fed sheet, thereby certainly avoiding double-feeding certainly.

Due to the above operation, the leading end of the sheet S is fed toward the nip of the pair of registration rollers 81. The sheet detecting sensor 82 comprising a photo-interrupter or the like is disposed at an upstream side of the pair of registration rollers 81 so that, when the leading end of the sheet S is detected by the sensor (step 4), by a timer means (not shown) of the CPU 40 for counting a time corresponding to the distance between the sensor 82 and the pair of registration rollers 81, a signal for controlling the stop timing of the draw clutch 60 to form a proper loop between the pair of draw rollers 55 and the pair of registration rollers 81 is generated (step 6).

It is well known that such a loop is formed in the sheet S to correct skew-feeding of the sheet. Further, by rotating the pair of registration rollers 81 in response to an image leading end synchronous signal emitted from the photosensitive drum 12 or the optical system for exposing the image, the sheet S is fed again to be sent onto the photosensitive drum 12, where a toner image is transferred onto the sheet.

When a predetermined time period T2 (sec) is elapsed after the trailing end of the sheet S leaves the sheet detecting sensor 82 to ascertain the fact that the trailing end of the sheet S surely leaves the nip of the pair of registration rollers 81, a registration clutch 83 is turned OFF (steps 9, 10 and 11). Incidentally, the sheet S to which the toner image was transferred is sent to the fixing unit 22, where the image is fixed to the sheet. Thereafter, the sheet is discharged onto the discharge tray 25.

The above-mentioned operations are repeated by a number of times corresponding to the set number of sheets to be treated (step 12). When the predetermined number is completed, the draw clutch 60 is turned OFF (step 13), and then the sheet feeding motor M1 and the draw motor M2 are stopped (step 14), and the program is ended.

As fully mentioned above, the sheet S fed from the intermediate plate 70 is fed, and the intermediate plate 70 (urged against the sheet feeding roller 51) is retracted from the sheet feeding roller 51. In this case, since the restoring force of the separating roller 53 can be utilized, the double-fed sheet(s) S can surely be restored, thereby achieving a highly reliable sheet feeding operation.

Further, when the sheet S is fed by the pair of draw rollers 55, since the pressure contact between the sheets on the intermediate plate 70 and the sheet feeding roller 51 is released, the pair of draw rollers 55 are not subjected to the feeding load due to pinching pressure generated by the pressure between the intermediate plate 70 and the sheet feeding roller 51. Thus, the service life of the draw rollers can be extended.

Further, in the initial state, since the intermediate plate 70 is retracted from the sheet feeding roller 51, the setting of the sheets effected by the operator is not obstructed. When the operator sets the sheets, he may merely abut the leading end of the sheet bundle against the abutment plate 78. Thus, since the setting operation is very easy, occurrence of a sheet jam and skew-feeding due to poor setting can be reduced.

In addition, the synchronous operation between the intermediate plate 70 and the sheet feeding roller 51 is effected by the control gear 80 formed integrally with the cam 80*c* for controlling the intermediate plate 70 and the toothless portion 80*a*. As a timing of feeding the sheet, a timing of applying a pressure between the intermediate plate 70 and the sheet feeding roller 51, and a timing of releasing the pressure determined by the phase angles of the cam 80*c* and the toothless portion 80*a*, there are few factors for causing dispersion, with the result that the stable sheet feeding and separating operations can be effected with low cost.

Since the control for rotation of the sheet feeding roller 51 and the application and release of the pressure of the intermediate plate 70 can be effected by one ON signal and one OFF signal for the solenoid 69, the control is very easy and the severe control accuracy is not requested.

Further, since the pair of draw rollers 55 are synchronous with the drive shaft 54 of the separating roller and the control thereof is effected by the single draw clutch 60, not only can the apparatus can be simplified but also such control can be effected independently from the rotation of the sheet feeding roller 51. Thus, even in the state that the sheet feeding roller 51 is stopped, the restoring force of the separating roller 53 can be utilized, thereby providing the sheet feeding apparatus having high double-feed preventing ability.

Next, a multisheet feeding portion of an image forming apparatus according to an alteration of the illustrated embodiment of the present invention will be explained.

Figure 8:
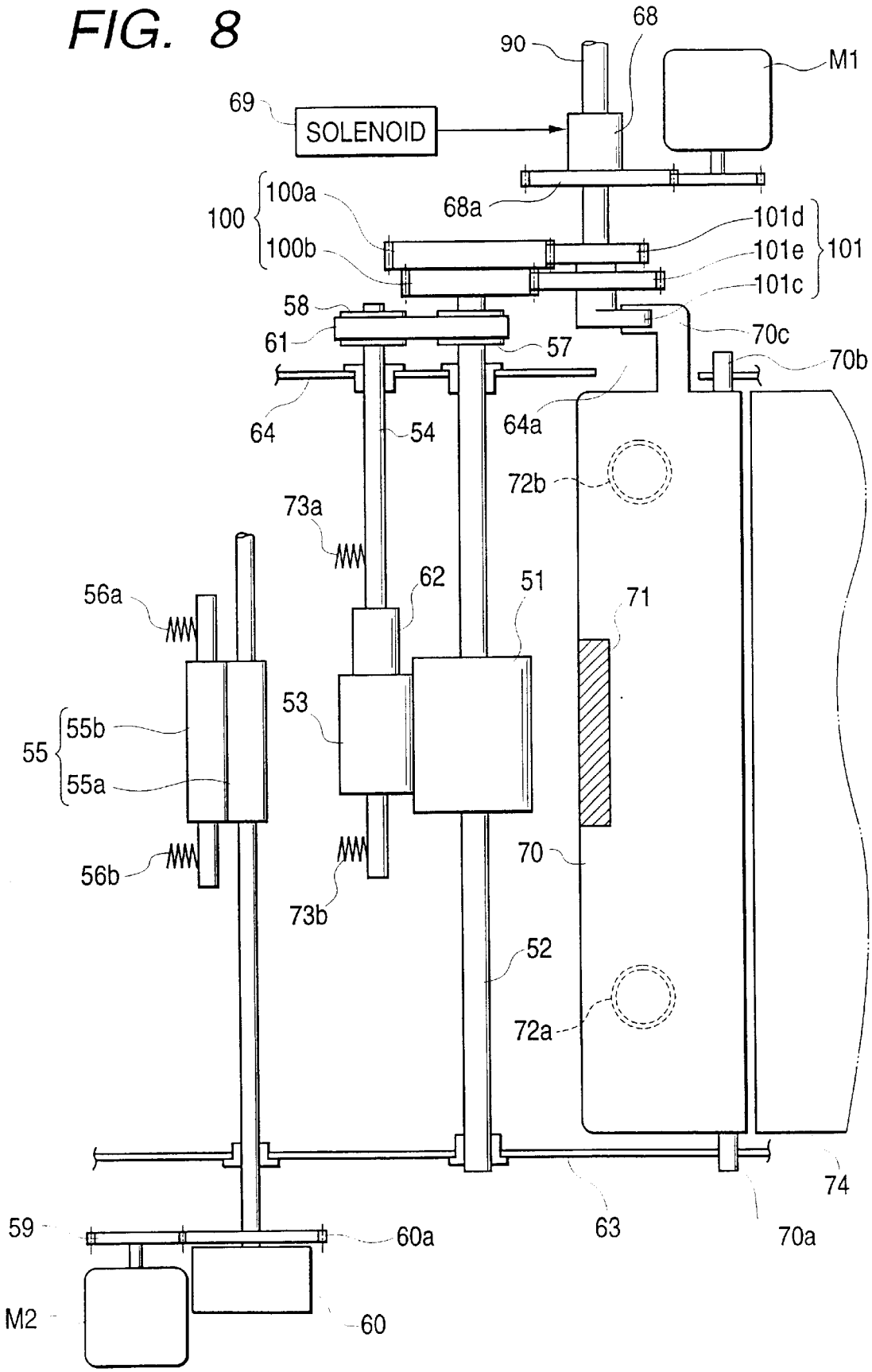
FIG. 8 is a drive development view (plan view) of a sheet feeding apparatus according to an alteration of the embodiment of the present invention.

FIG. 8 is a drive development view of a multisheet feeding portion according to such an alteration. Incidentally, the same elements as those in the above-mentioned illustrated embodiment are designated by the same reference numerals and an explanation thereof will be omitted. In this alteration, a sheet feeding drive stage gear 100 as a drive transmitting means comprising an integral forming of a large diameter gear 100*a* and a small diameter gear 100*b* is secured to the rear end of the support shaft 52 of the sheet feeding roller 51.

Further, a control gear (stage gear of the drive transmitting means) 101 having first and second sector gear portions 101*d*, 101*e* engageable with the large diameter gear 100*a* and the small diameter gear 100*b* of the sheet feeding drive stage gear 100 and nonengagement portions 101*a*, 101*b* which are not engaged by the sheet feeding drive stage gear 100 is disposed in a confronting relationship to the large diameter gear 100*a* and the small diameter gear 100*b* of the sheet feeding drive stage gear 100. A cam (pressing and retracting means) 101*c* for bringing the sheets on the intermediate plate 70 into pressure contact with the sheet feeding roller (sheet feeding means) 51 and releasing the pressure contact is integrally formed with the control gear 101.

A cam follower 70*c* formed integrally with the rear end of the intermediate plate 70 and extending through a hole 64*a* of the rear side plate 64 up to an abutment position of the cam 101*c* can abut against the cam 101*c*. The control gear 101 is secured to a drive shaft 90 on which the spring clutch 68 is provided. One revolution (at a predetermined rotating speed) of the spring clutch 68 is controlled by transmitting the driving force of the sheet feeding motor M1 to the spring clutch 68 by turning ON the solenoid 69 for controlling the spring clutch 68 by a time of T1 (sec).

Further, a pulley (connecting means) 57 is secured to the rear end of the support shaft 52. Since a recipient pulley 58 to which a driving force is transmitted from a pulley 57 on the support shaft 52 through a belt 61 passed over the pulleys 57, 58 are secured to the shaft 54 of the separating roller 53, the shaft 54 of the separating roller 53 is rotated in the same direction as the support shaft 52 in synchronous with the rotation of the support shaft 52.

Phase angles of the spring clutch 68 and the nonengagement portion 101*a* are selected so that the nonengagement portion 101*a* of the control gear 101 is normally opposed to the sheet feeding drive stage gear 100. Further, in this alteration, the one-way clutch 91 disposed between the front side plate 63 and the support shaft 52 and used in the above-mentioned illustrated embodiment is omitted.

Thus, in the initial stage, although a slight rotational load of the torque limiter 62 acts on the sheet feeding drive stage gear 100, the support shaft 52 and the sheet feeding roller 51, the sheet feeding drive stage gear 100, the support shaft 52 and the sheet feeding roller 51 can be rotated both in the sheet feeding direction and in the opposite direction.

Since the pair of draw rollers 55 disposed at the downstream side of the sheet feeding roller 51 in the sheet feeding direction and the members for driving the pair of draw rollers are the same as those in the above-mentioned embodiment, an explanation thereof will be omitted. Further, since the setting of the torque value of the torque limiter 62 provided on the drive shaft 54 of the separating roller 53 is the same as the above-mentioned embodiment, an explanation thereof will also be omitted.

The rotating speed of the draw motor M2, the outer diameter of the sheet feeding roller 51 and the number of teeth of the gears are selected so that the feeding speed of the pair of draw rollers 55 becomes a second feeding speed V2 substantially equal to the feeding speed of the pair of registration rollers 81 (disposed at the downstream side of the pair of draw rollers 55 in the sheet feeding direction) for correcting the skew-feeding of the sheet and for synchronizing the sheet with the toner image on the photosensitive drum.

Next, the drive transmitting means and the pressing and retracting means for the sheet feeding roller 51 and the intermediate plate 70 will be fully explained with reference to FIGS. 9A to 9E and FIGS. 10A to 10G. As mentioned above, the control gear 101 formed integrally with the first and second sector gear portions 101*d*, 101*e* engageable with the large diameter gear 100 *a* and the small diameter gear 100*b* of the sheet feeding drive stage gear 100, the two nonengagement portions 101*a*, 101*b* which are not engaged by the sheet feeding drive stage gear 100, and the cam 101*c* for applying a pressure between the intermediate plate 70 and the sheet feeding roller 51 and releasing the pressure is disposed in a confronting relationship to the sheet feeding drive stage gear 100.

As is in the aforementioned control gear 80, one revolution of the control gear 101 can be controlled by the spring clutch 68 and the solenoid 69. Incidentally, since the construction of the spring clutch 68 does not relate to the present invention, a detailed explanation thereof will be omitted.

Since the phase angle of the spring clutch 68 and the configuration and position of the first nonengagement portion 101*a* are selected so that the first nonengagement portion 101*a* of the control gear 101 is normally opposed to the sheet feeding drive stage gear 100, the sheet feeding roller support shaft 52 can be rotated both in the sheet feeding direction and in the opposite direction.

Further, cam 101*c* abuts against the cam follower 70*c* provided at the end of the intermediate plate 70, and the configuration of the cam 101*c* and the phase angle between the cam 101*c* and the nonengagement portion 101*a* are selected so that the cam 101*c* normally separates the intermediate plate 70 from the sheet feeding roller 51 against the force of the compression spring 72. Thus, when the operator sets the sheet bundle, since the intermediate plate 70 is retracted from the sheet feeding roller 51, the sheet bundle can easily be inserted until the sheet bundle abuts against the abutment plate 78.

Next, the sheet feeding and separating operations by using the drive transmitting means and the pressing and retracting means will be explained.

When the solenoid 69 is turned ON by the time T1 (sec), the control gear 101 starts to rotate under the action of the spring clutch 68. When the control gear 101 is rotated in an counter-clockwise direction in FIG. 9A, first of all, the cam 101*c* is rotated from the intermediate plate retracting position to the intermediate plate pressing position $\alpha$1. During this rotation, the cam 101*c* is separated from the cam follower 70*c*, thereby moving the intermediate plate 70 to be urged against the sheet feeding roller 51.

Figure 9A:
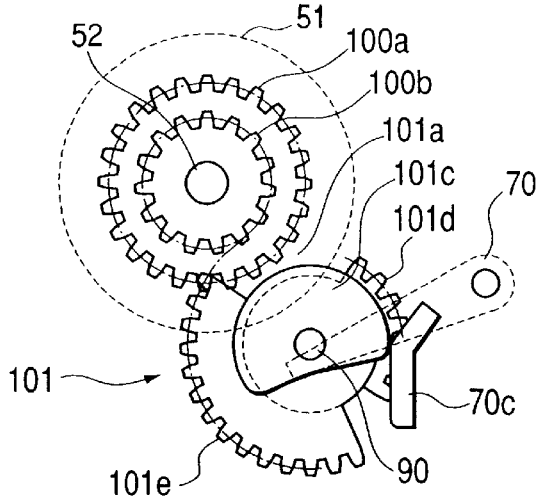
FIGS. 9A, 9B, 9C, 9D, 9E and 9F are views showing an operation of a control gear in the alteration.
Figure 9B:
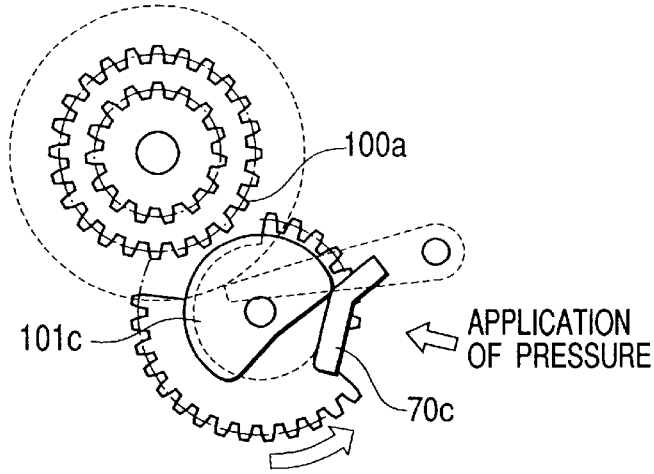
Figure 10A:
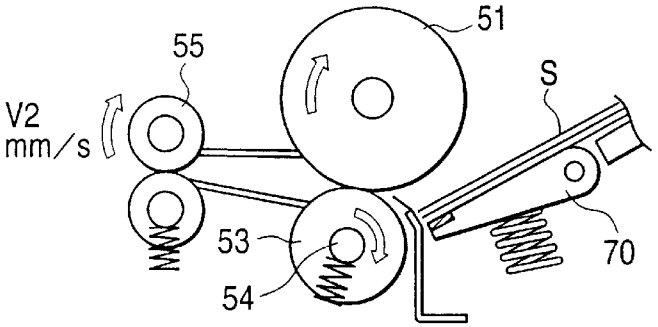
FIGS. 10A, 10B, 10C, 10D, 10E, 10F and 10G are views showing operations of a roller and an intermediate plate in the alteration.
Figure 10B:
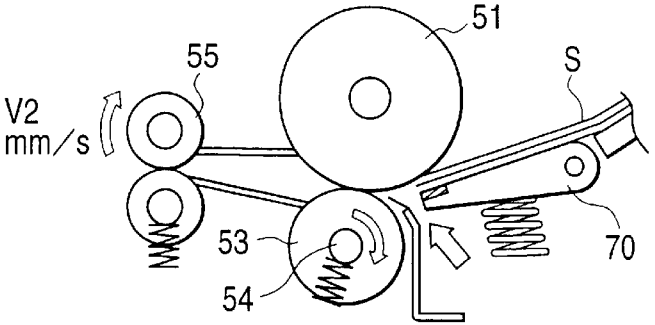

As a result, the uppermost sheet S in the sheet bundle rested on the sheet feeding tray 74 abuts against the sheet feeding roller 51 (FIGS. 9B and 10B).

When the control gear 101 is further rotated up to a position $\alpha$2, the first sector gear portion 101*d* of the control gear 101 is engaged by the large diameter gear portion 100*a* of the sheet feeding drive stage gear 100, thereby starting the sheet feeding drive stage gear 100 to rotate.

Incidentally, the rotating speed of the sheet feeding motor M1, the outer diameter of the sheet feeding roller 51 and the number of teeth of the gears are selected so that the feeding speed of the sheet feeding roller 51 at this time becomes a first feeding speed V1 lower than the second feeding speed V2 provided by the pair of registration rollers 81 and the pair of draw rollers 55.

Figure 9C:
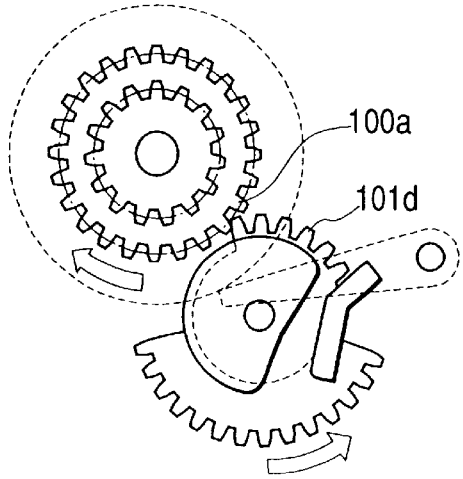
Figure 10C:
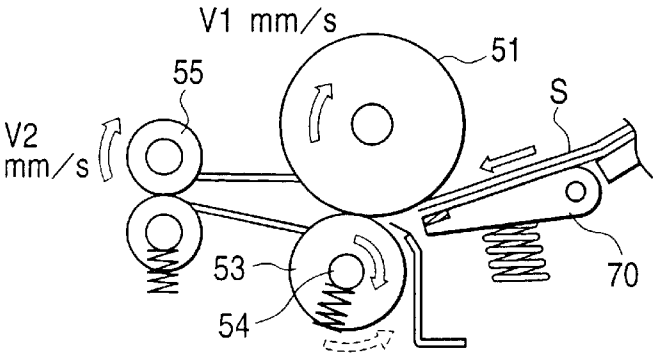

When the control gear 101 is further rotated up to a position $\alpha$3 the sheet feeding roller 51 is rotated by the rotation of the control gear 101, thereby feeding out the uppermost sheet S in the sheet bundle (FIGS. 9C and 10C).

Figure 9D:
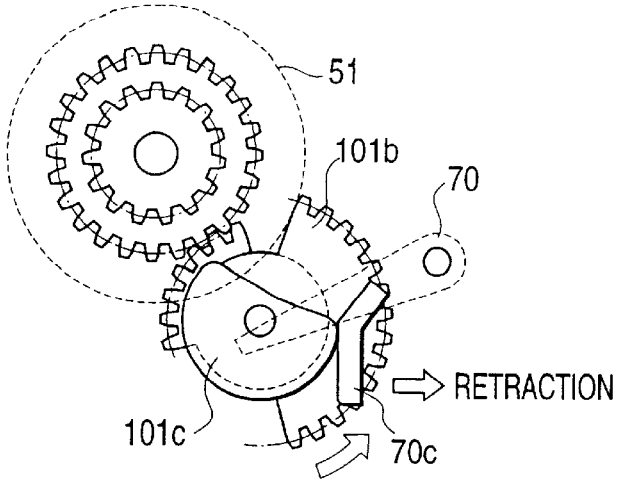
Figure 10D:
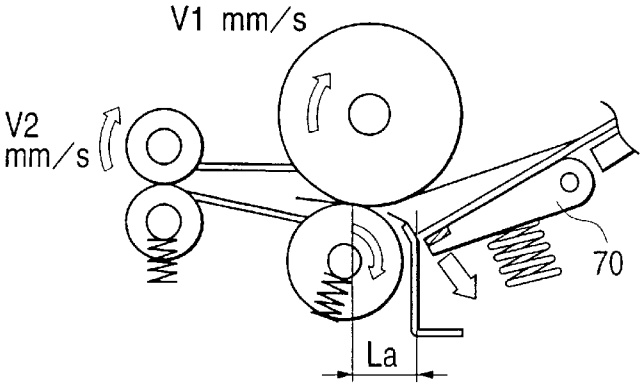

Since the phase angle is selected so that the cam 101*c* integrally formed with the control gear 101 is restored to the intermediate plate retracting position at the time when the control gear 101 is rotated up to the position $\alpha$3 the cam 101*c* abuts against the cam follower 70*c*, thereby moving the intermediate plate 70 away from the sheet feeding roller 51, with the result that the sheets on the intermediate plate 70 is released from the pressure of the sheet feeding roller 51 (FIGS. 9D and 10D).

When the control gear 101 is rotated up to a position $\alpha$4, the sheet S is fed out by a predetermined amount L1 (the sheet feeding operation up to this step is referred to as "first sheet feeding operation" hereinafter). Incidentally, the number of teeth of the first sector gear portion 101*d* is selected so that the sheet feeding amount L1 during the first sheet feeding operation becomes greater than a distance La from the sheet abutment portion 78 to the nip between the sheet feeding roller 51 and the separating roller 53 and smaller than a distance Lb from the nip to the pair of draw rollers 55.

In the first sheet feeding operation, if the sheets should be double-fed into the nip between the sheet feeding roller 51 and the separating roller 53, the sheet feeding roller 51 is rotated in the sheet feeding direction by the driving force from the drive motor M1 and the driving force is transmitted to the drive shaft 54 of the separating roller 53 through the pulley 57, 58 and the belt 61. Thus, the drive shaft 54 of the separating roller 53 is rotated in the direction opposite to the sheet feeding direction, and restraint of the double-fed sheets is released by pressure release of the intermediate plate 70. At this point, the separating roller 53 starts to rotate in the restoring direction under the action of the torque limiter 62 until the double-fed sheets caused by the sheet feeding operation leave the nip between the sheet feeding roller 51 and the separating roller 53, thereby certainly avoiding double-feeding.

Figure 9E:
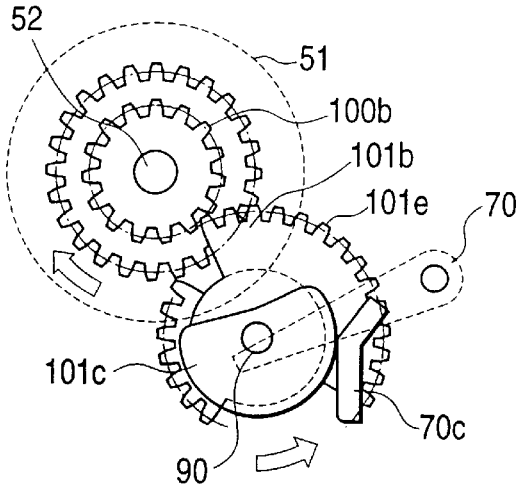
Figure 10E:
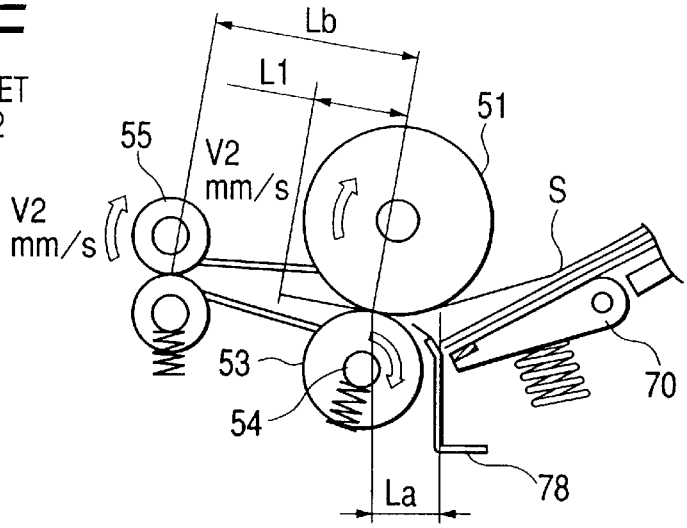

Then, the first sector gear portion 101*d* of the control gear 101 is disengaged from the large diameter gear portion 100*a* of the sheet feeding drive stage gear 100, and the second sector gear portion 101*e* of the control gear 101 starts to engage with the small diameter gear portion 100*b* of the sheet feeding drive stage gear 100 (FIGS. 9E and 10E). From this point, the feeding speed of the sheet feeding roller 51 is switched from the first feeding speed V1 to the second feeding speed V2, and the roller is rotated in the sheet feeding direction.

Incidentally, diameters and phase angles of the sheet feeding drive stage gear 100 and the control gear 101 are selected so that the drive transmission from the control gear 101 to the sheet feeding drive stage gear 100 is not interrupted when the gear change is effected between the sheet feeding drive stage gear 100 and the control gear 101. Further, the second nonengagement portion 101*b* is provided between the first sector gear portion and the second sector gear portion of the control gear 101. However, the second nonengagement portion 101*b* does not interrupt the drive transmission from the control gear 101 to the sheet feeding drive stage gear 100 and has a purpose for making the control gear 101 simpler and inexpensive.

When the control gear 101 is further rotated to bring the first nonengagement portion 101*a* to a position opposed to the small diameter gear portion 100*b* of the sheet feeding drive stage gear 100, the sheet feeding drive stage gear 100 does not receive the driving force, thereby stopping the sheet feeding roller 51.

Figure 9F:
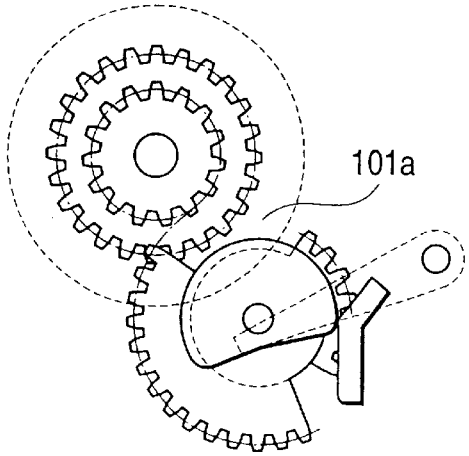
Figure 10F:
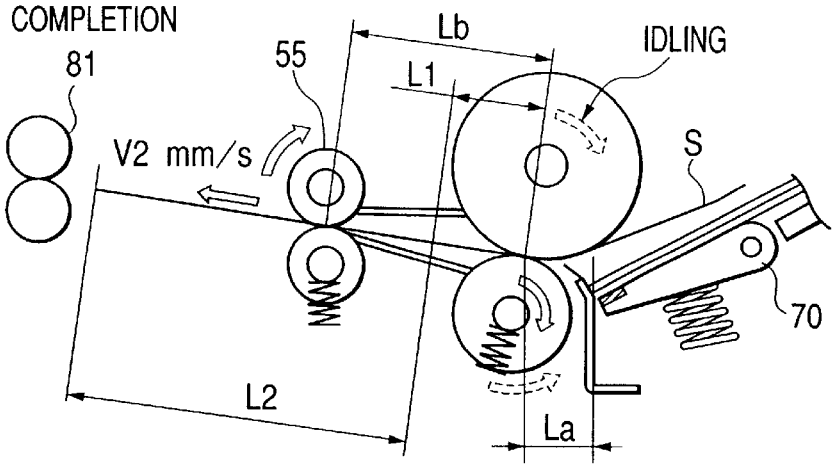
Figure 10G:
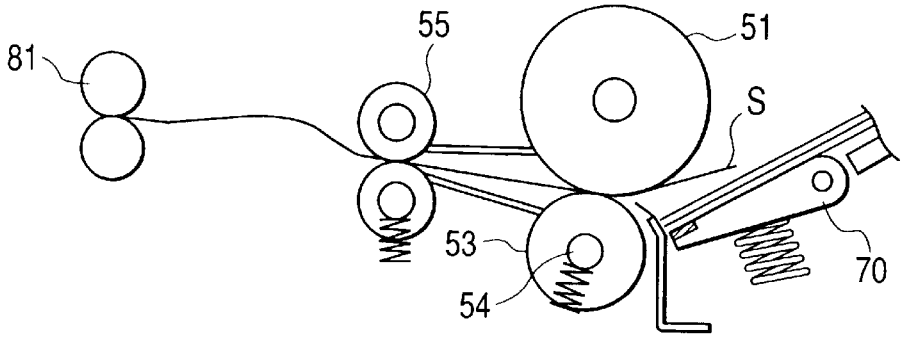

One revolution of the control gear 101 is completed, and the control gear is stopped at the initial position (FIGS. 9F and 10F). At this stage the sheet S is fed out by a predetermined amount $L_2$ (this sheet feeding operation after the first sheet feeding operation is referred to as "second sheet feeding operation" hereinafter). The number of teeth of the second sector gear portion 101*e* is selected so that the sheet feeding amount L2 ensures that the leading end of the sheet S (at the second feeding speed V2) is surely received by at least the pair of draw rollers 55 after the sheet S fed out from the intermediate plate 70 at the first feeding speed V1 is separated and that the sheet does not still reach the pair of registration rollers 81. Further, the outer diameter of the sheet feeding roller 51, the rotating speed of the sheet feeding motor M1 and the number of teeth of the gears are selected so that the second feeding speed V2 of the sheet feeding roller 51 at this time becomes equal to the feeding speeds of the pair of registration rollers 81 and the pair of draw rollers 55.

Figure 11:
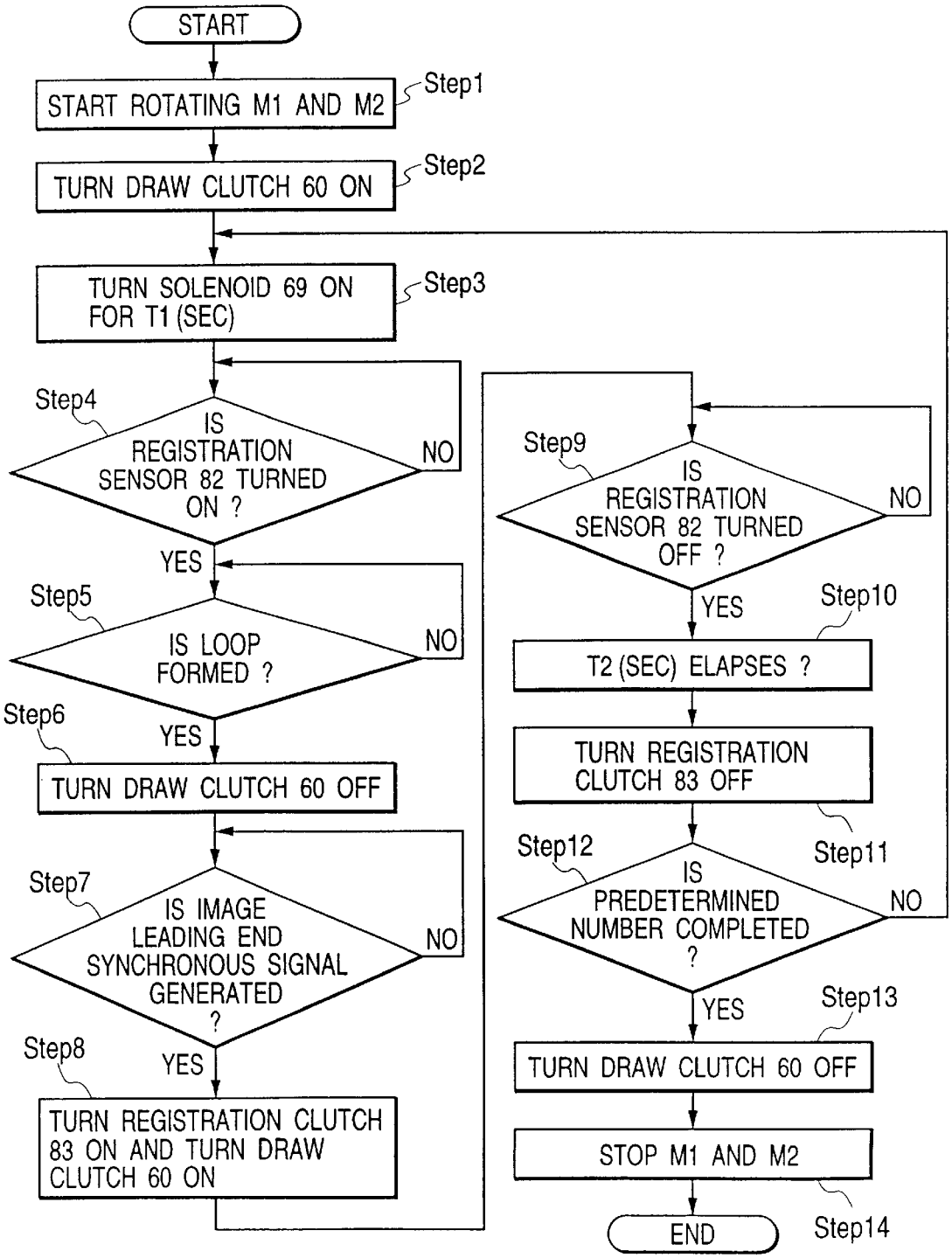
FIG. 11 is a flowchart showing a sheet feeding operation in the alteration.
Figure 12:
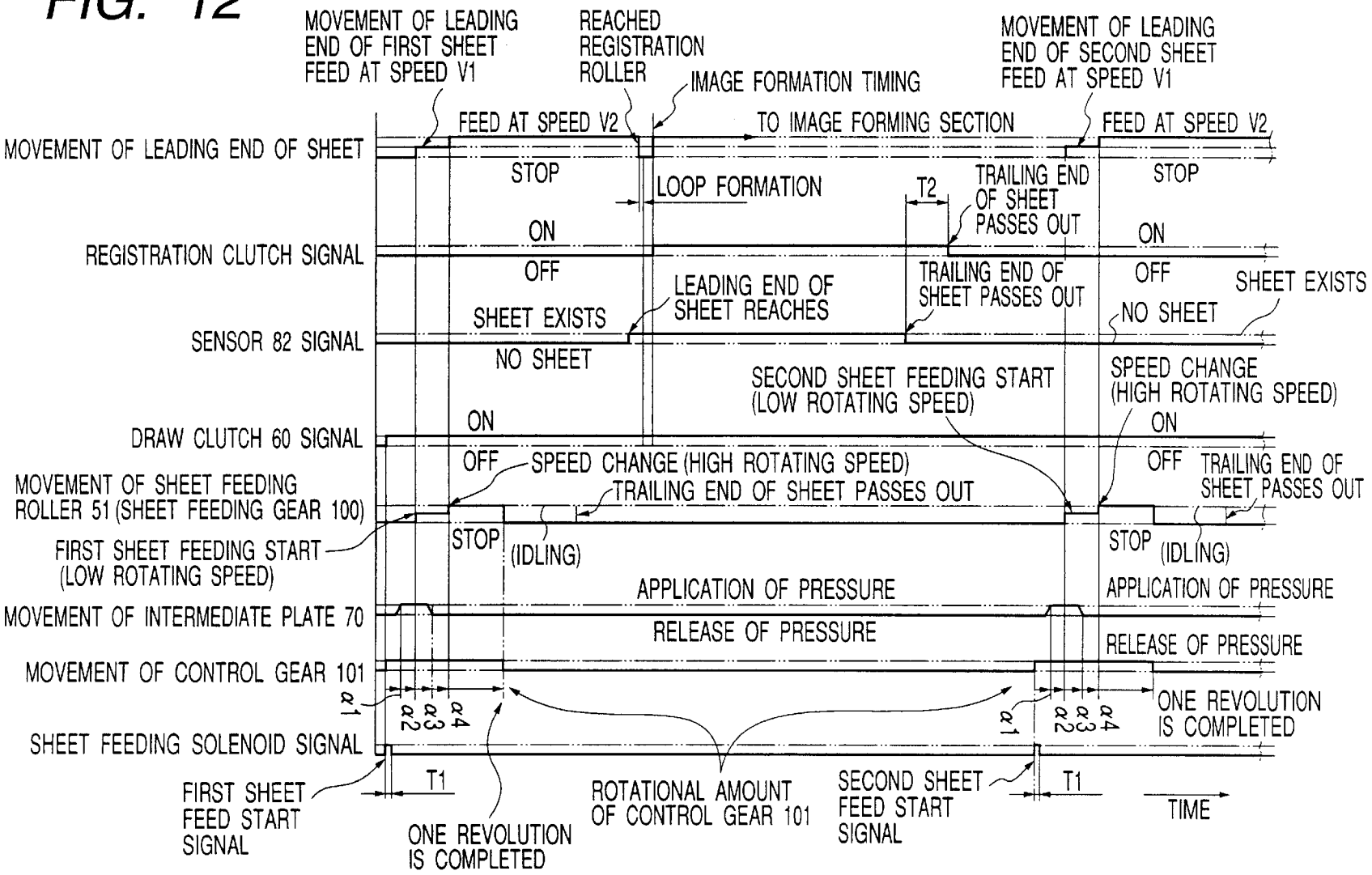
FIG. 12 is a timing chart showing a sheet feeding operation in the alteration.

Next, the sheet feeding operation of the multisheet feeding portion will be explained with reference to a flowchart shown in FIG. 11 and a timing chart shown in FIG. 12.

In a state that the sheet bundle is rested on the sheet feeding tray 74, when a start button (not shown) is depressed, the draw motor $M_2$ and the sheet feeding motor $M_1$ start to rotate (step 1), and an ON signal of the draw clutch 60 is emitted from a CPU 40 (step 2).

Then, after a predetermined time period is elapsed, the solenoid 69 is turned ON by a time period T1 (sec) on the basis of a signal from the CPU 40 (step 3) to start control of one revolution of the control gear 101. By this operation, as mentioned above, first of all, the intermediate plate 70 is moved to be urged against the sheet feeding roller 51, with the result that the sheet bundle supported on the intermediate plate 70 abuts against the sheet feeding roller 51. Then, the sheet feeding roller 51 is rotated to feed out the uppermost sheet S in the sheet bundle rested on the tray 74 by the predetermined amount L1 at the first feeding speed $V_1$ by the pressing force of the intermediate plate 70 and the friction force between the sheet and the sheet feeding roller 51 (the first sheet feeding operation).

At this time, the separation roller 53 is driven in the sheet feeding direction by the rotation of the sheet feeding roller 51. By the way, in the above-mentioned sheet feeding operation, if two or more sheets are fed in an overlapped state (i.e., if double-feed occurs), the separating roller 53 acts to restore the double-fed sheet(s). At this time, however, since the intermediate plate 70 urges the sheet feeding roller 51 via the intermediate plate spring 72, the separating operation of the separating roller 53 may be obstructed so not to restore the double-fed sheet(s).

However, at this time, when the control gear 101 is further rotated, the intermediate plate 70 is released from the pressure and retracted from the sheet feeding roller 51 by the engagement between the cam 101*c* and the cam follower 70*c*. Incidentally, as mentioned above, since the first feeding speed V1 during the first sheet feeding operation is lower than the second feeding speed V2 provided by the pair of registration rollers 81 and the pair of draw rollers 55, in the first sheet feeding operation, double-feeding is unlikely to occur and any slippage of the sheet feeding roller 51 is also unlikely to occur, thereby providing the stable sheet feeding operation.

Since slippage is unlikely to occur as mentioned above, the pressing force of the intermediate plate 70 against the sheet feeding roller 51 can be set to a smaller value. Thus, the double-feeding is even more unlikely to occur.

When the control gear 101 is further rotated, the sheet feeding roller 51 feeds the sheet S at the second feeding speed V2, and the leading end of the sheet S is received by the pair of draw rollers 55 which are rotated at the second feeding speed V2. After the sheet is fed by the sheet feeding roller 51 by the predetermined amount L2, the control of one revolution of the control gear 101 is completed and the sheet feeding roller 51 is stopped. However, since the pair of draw rollers 55 continue to rotate, the sheet S is fed up to the pair of registration rollers 81.

At this time, since the first nonengagement portion 101*a* of the control gear 101 is opposed to the sheet feeding drive stage gear 100, the sheet feeding roller 51 is not subjected any load. Thus, the sheet feeding roller 51 is rotatingly driven (idle rotation) by the sheet S being fed by the pair of draw rollers 55 until the trailing end of the sheet S leaves the nip between the sheet feeding roller 51 and the separating roller 53.

In this drawing operation, since the intermediate plate 70 is retracted from the sheet feeding roller 51, a succeeding sheet is not subjected to a friction force from the sheet S being drawn. Thus, the succeeding sheet is unlikely to be double-fed. However, if the succeeding sheet should be double-fed, during the operation of the pair of draw rollers 55, since the support shaft 52 is similarly rotatingly driven by the rotation of the sheet feeding roller 51 and the drive shaft 54 of the separating roller 53 connected to the support shaft 52 is rotated in the direction opposite to the sheet feeding direction and the intermediate plate 70 is released from the pressure of the sheet feeding roller 51 to release the pressure on the sheets on the intermediate plate 70, at that point, the separating roller 53 starts to rotate reversely by the action of the torque limiter 62 to restore the double-fed sheet, certainly avoiding double-feeding.

If the sheet is jammed in the nip between the sheet feeding roller 51 and the separating roller 53 or if the sheet is caught by the nip of the pair of draw rollers 55 for any reason, in this alteration, since the sheet feeding roller 51 can be rotated both in the sheet feeding direction and in the opposite direction, the jammed sheet can be pulled in the direction opposite to the sheet feeding direction, thereby facilitating the sheet jam treatment.

This can be achieved because the control gear 101 has the nonengagement portions not engaged by the sheet feeding drive stage gear 100 and because there is no need for providing means such as a one-way clutch for connecting the driving between the sheet feeding roller 51 and the separating roller 53 to regulate the rotation.

That is to say, when the control gear 101 is disengaged from the sheet feeding drive stage gear 100, the sheet feeding roller support shaft 52 can freely be rotated both in the sheet feeding direction and in the opposite direction. Thus, the jammed sheet can be pulled in the direction opposite to the sheet feeding direction.

Further, when the sheet is draw by the pair of draw rollers 55, the sheet feeding roller 51 is rotatingly driven, and the rotation of the sheet feeding roller 51 is transmitted to the shaft 54 of the separating roller 53 through the pulleys 57, 58 and the belt 61, with the result that the shaft 54 of the separating roller 53 can always be rotated in the sheet restoring direction. Namely, even if a plurality of sheets are fed into the nip between the sheet feeding roller 51 and the separating roller 53, under the action of the torque limiter 62, the separating roller 53 can be rotated to restore the sheet onto the intermediate plate 70.

The leading end of the sheet S is fed at the second feeding speed V2 toward the pair of registration rollers 81 which are stopped, by the above-mentioned operation. A sheet detecting sensor 82 comprising a photo-interrupter or the like is disposed at an upstream side of the pair of registration rollers 81 so that, when the leading end of the sheet S is detected by the sensor (step 4), by a timer means (not shown) of the CPU 40 for counting a time corresponding to the distance between the sensor 82 and the pair of registration rollers 81, a signal for controlling the stop timing of the draw clutch 60 to form a proper loop between the pair of draw rollers 55 and the pair of registration rollers 81 is generated (step 6).

It is well known that such a loop is formed in the sheet S to correct skew-feeding of the sheet. Further, by rotating the pair of registration rollers 81 in response to an image leading end synchronous signal emitted from the photosensitive drum 12 or the optical system for exposing the image, the sheet S is fed again at the second feeding speed V2 to be sent onto the photosensitive drum 12 rotated at the second feeding speed V2, where the toner image is transferred onto the sheet.

When a predetermined time period T2 (sec) is elapsed after the trailing end of the sheet S leaves the sheet detecting sensor 82 to ascertain the fact that the trailing end of the sheet surely leaves the nip of the pair of registration rollers 81, a registration clutch 83 is turned OFF (steps 9, 10 and 11). Incidentally, the sheet S to which the toner image is transferred is sent to the fixing unit 22, where the image is fixed to the sheet. Thereafter, the sheet is discharged onto the discharge tray 25. The above-mentioned operations are repeated by a number of times corresponding to the set number of sheets to be treated (step 12). When the predetermined number is completed, the draw clutch 60 is turned OFF (step 13), and then the sheet feeding motor M1 and the draw motor M2 are stopped (step 14), and the program is ended.

As fully mentioned above, in this alteration, since the first feeding speed V1 in the first sheet feeding operation is lower than the second feeding speed V2 provided by the pair of draw rollers 55 and the pair of registration rollers 81, in the first sheet feeding operation, double-feeding is unlikely to occur and the slippage between the sheet feeding roller 51 and the sheet S is also unlikely to occur, thereby providing the stable sheet feeding operation.

Furthermore, since the double-feed preventing arrangement is used, the torque value (sheet restoring force of the sheet separating roller 53) of the torque limiter 62 can be set to a smaller value. Further, since occurrence of the slippage during the first sheet feeding operation can be reduced, the pressing force of the intermediate plate 70 against the sheet feeding roller 51 can be set to a smaller value, thereby improving the service lives of the sheet feeding roller 51 and the separating roller 53. Thus, a sheet feeding apparatus having low maintenance cost can be provided.

Further, when the sheet S is fed by the pair of draw rollers 55, since the intermediate plate 70 is already retracted from the sheet feeding roller 51, the pair of draw rollers 55 are not subjected to the feeding load due to the pressure of the intermediate plate. Thus, the service life of the draw rollers 55 can be extended.

Further, in the initial state, since the intermediate plate 70 is retracted from the sheet feeding roller 51, the setting of the sheet bundle effected by the operator is not obstructed. When the operator sets the sheets, he may merely abut the leading end of the sheet bundle against the abutment plate 78. Thus, since the setting operation is very easy, occurrence of sheet jamming due to poor setting can be reduced.

In addition, since the interlocking operation between the intermediate plate 70 and the sheet feeding roller 51 is effected by the control gear 101 formed integrally with the cam 101*c* for controlling the intermediate plate 70 and the two nonengagement portions 101*a*, 101*b* and since the timings for feeding the sheet and for applying and releasing a pressure between the intermediate plate 70 and the sheet feeding roller 51 are determined by the phase angles of the nonengagement portions 101*a*, 101*b* and the cam 101*c*, there are few factors for causing dispersion, with the result that the stable sheet feeding and separating operations can be effected with low cost.

Since the control for rotation and stoppage of the sheet feeding roller 51 and the complication and release of the pressure of the intermediate plate 70 can be effected by one ON signal and one OFF signal for the solenoid 69, the control is very easy and the severe control accuracy is not requested.

Further, by connecting the shaft 54 of the separating roller 53 to the sheet feeding roller support shaft 52, means such as a one-way clutch for regulating the rotational direction which was required in the conventional sheet feeding apparatuses can be omitted, thereby making the sheet feeding apparatus inexpensive. In addition, since the shaft 54 of the separating roller 53 can always be rotated in the sheet restoring direction by rotatingly driving the sheet feeding roller 51 by the sheet drawn by the pair of draw rollers 55, the separating ability can be improved.

In this alteration, when the control gear 101 is in the initial state, since the nonengagement portion 101*a* of the control gear 101 is opposed to the sheet feeding drive stage gear 100, although slight rotational resistance of the torque limiter 62 acts on the sheet feeding roller 51 and the separating roller 53, these rollers can freely be rotated in both directions. Thus, if the sheet is jammed in the sheet feeding portion, the jammed sheet can be pulled both in the sheet feeding direction and in the opposite direction, thereby greatly improving the jam treating ability.

Incidentally, in the alteration, while an example that the pulley 57, 58 are provided on the sheet feeding roller support shaft 52 and the separating roller shaft 54, respectively and the pulleys 57, 58 are interconnected through the belt 61 to transmit the driving force from the sheet feeding motor M1 is explained, a connecting gear may be provided on the sheet feeding roller support shaft 52 and a separating roller gear may be provided on the shaft 54 of the separating roller 53 and a driving force may be transmitted through a gear train including idler gear(s) which engages with the connecting gear and the separating roller gear. This construction can also have the same technical advantage as the above alteration.

Now, a difference in appropriate sheet feeding area between the earlier technologies and the present invention will be explained with reference to the accompanying drawings.

Figure 13:
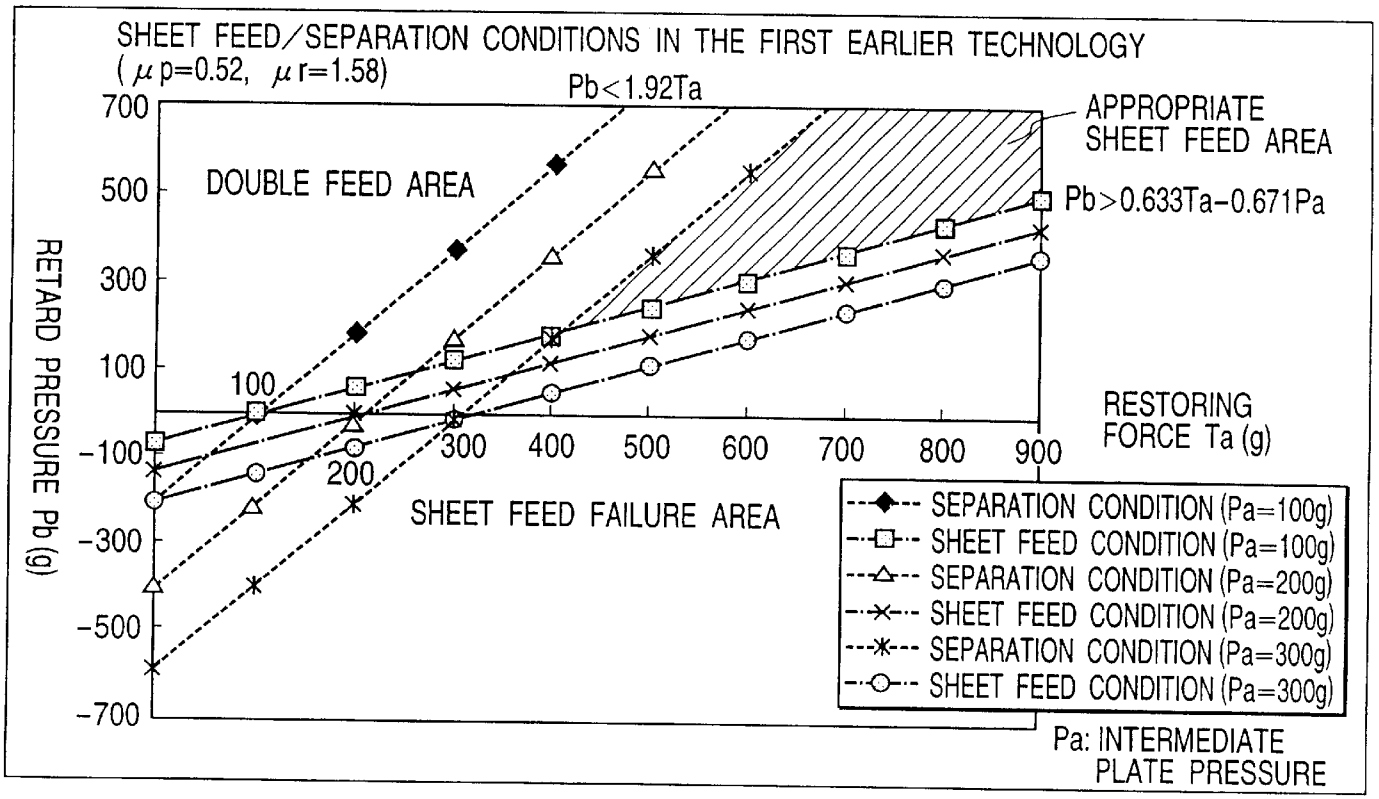
FIG. 13 is a graph showing an appropriate sheet feeding area in a first earlier technology ($\mu p$=0.52, $\mu r$=1.58)
Figure 15:
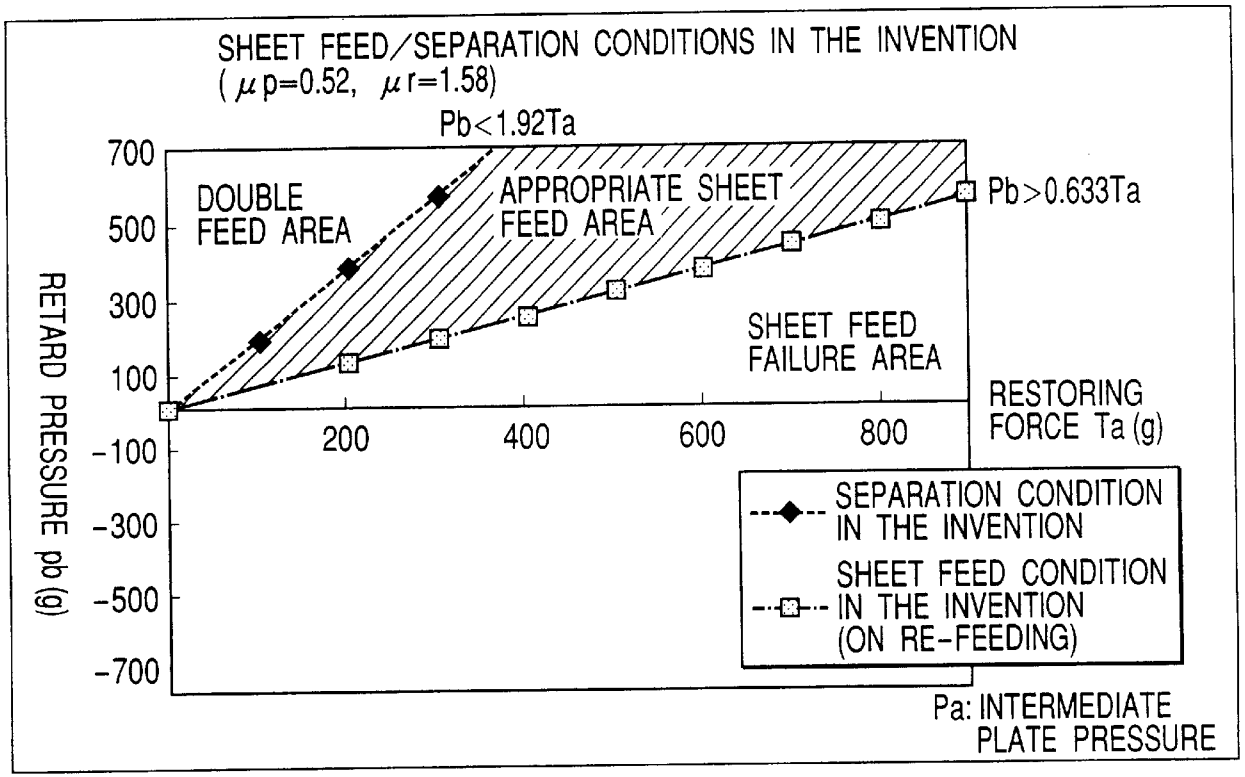
FIG. 15 is a graph showing an appropriate sheet feeding area in the present invention ($\mu p$=0.52, $\mu r$=1.58)

The appropriate sheet feeding area of the sheet feeding apparatus according to the present invention is shown in FIG. 15. Further, as mentioned above, FIG. 13 shows the appropriate sheet feeding area of the sheet feeding apparatus according to the first earlier technology (values are calculated values). Incidentally, the numerical values and formulae (expressions) used in FIG. 13 are quoted from those used in the first earlier technology. Such expressions are as follows:

Expression of sheet feed condition $$Pb>Ta/\mu r+((\mu p/\mu r)-1)Pa \qquad \text{Expression (1)}$$

Expression of separation condition $$Pb<Ta/\mu p-2Pa \qquad \text{Expression (2)}$$

here, Pb is retard pressure, Ta is a sheet restoring (returning) force of the separating roller, Pa is intermediate plate pressure, $\mu p$ is a coefficient of friction between the sheets, and $\mu r$ is a coefficient of friction between the sheet and the sheet feeding roller or the separating roller.

Incidentally, Ta is a value obtained from the following equation:

$$Ta=(\text{torque of a torque limiter})/(\text{radius of a separating roller})$$

In FIGS. 13 and 15, a relationship between the sheet restoring force Ta, the intermediate plate pressure Pa and the retard pressure Pb is formulated as mentioned above, and the sheet feed condition and the separation condition are sought regarding Pa=100 g, 200 g, 300 g, respectively. However, when the present invention is used, in the separating operation and in the second sheet feeding operation, since the intermediate plate is retracted from the sheet feeding roller, the intermediate plate pressure Pa is not generated. Thus, the sheet feed condition (in the second sheet feeding operation) and the separation condition are expressed as a function of only the restoring force Ta and the retard pressure Pb. The sheet feed condition and the separation condition in the present invention are as follows:

Expression of sheet feed condition $$Pb>Ta/\mu r \qquad \text{Expression (3)}$$

Expression of separation condition $$Pb<Ta/\mu p \qquad \text{Expression (4).}$$

Incidentally, assuming that the frictional coefficient $\mu p$ between the sheets and the frictional coefficient $\mu r$ between the sheet and the sheet feeding roller or the separating roller are 0.52 and 1.58, respectively in accordance with the first earlier technology, the calculation is performed.

In case of the first earlier technology in which the intermediate plate is urged against the sheet feeding roller in the separating operation, the relationship between the restoring force Ta of the separating roller and the retard pressure Pb is greatly influenced by the intermediate plate pressure Pa; and, when the restoring force Ta<400 g, there is no appropriate sheet feeding area. Since the intermediate plate pressures Pa vary with the number of sheets stacked on the intermediate plate, it is considered that it is very difficult to stabilize the appropriate sheet feeding area and to widen the range of the appropriate sheet feeding area in the first earlier technology.

To the contrary, the case of the present invention, since the intermediate plate is retracted from the sheet feeding roller in the separating operation, the relationship between the restoring force Ta of the separating roller and the retard pressure Pb is not influenced by the intermediate plate pressure Pa at all. Thus, the appropriate sheet feeding area can be maintained with a wide range.

Figure 14:
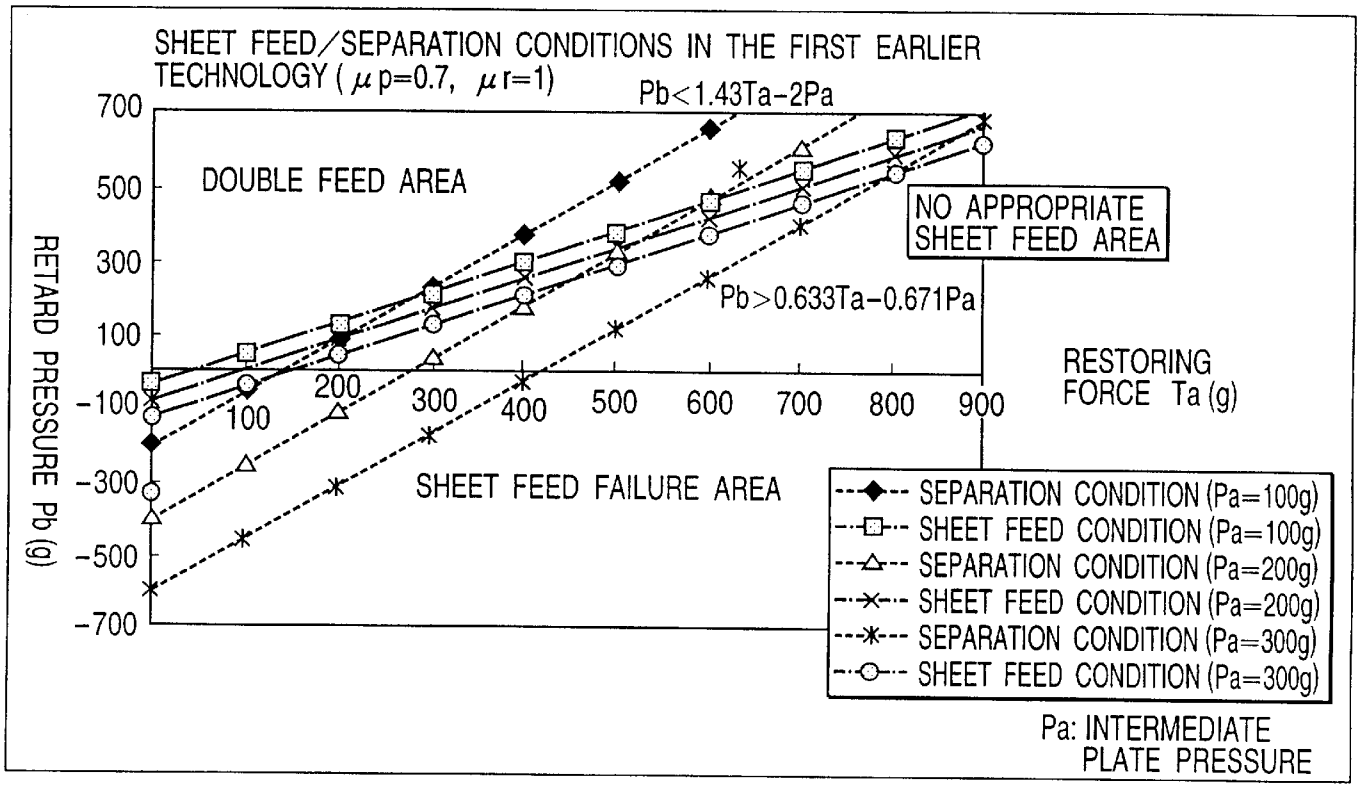
FIG. 14 is a graph showing an appropriate sheet feeding area in a first earlier technology ($\mu p$=0.7, $\mu r$=1.0)
Figure 16:
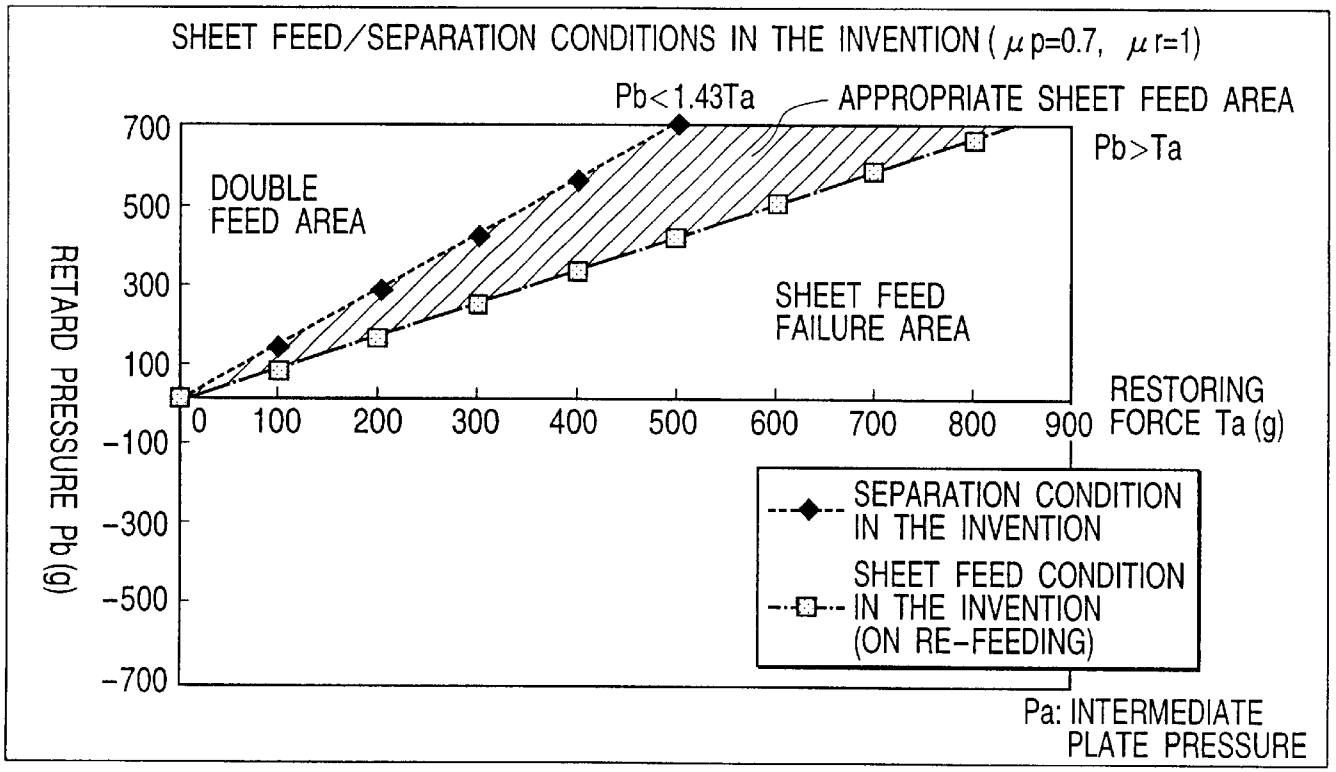
FIG. 16 is a graph showing an appropriate sheet feeding area in the present invention ($\mu p$=0.7, $\mu r$=1.0)
Figure 17:
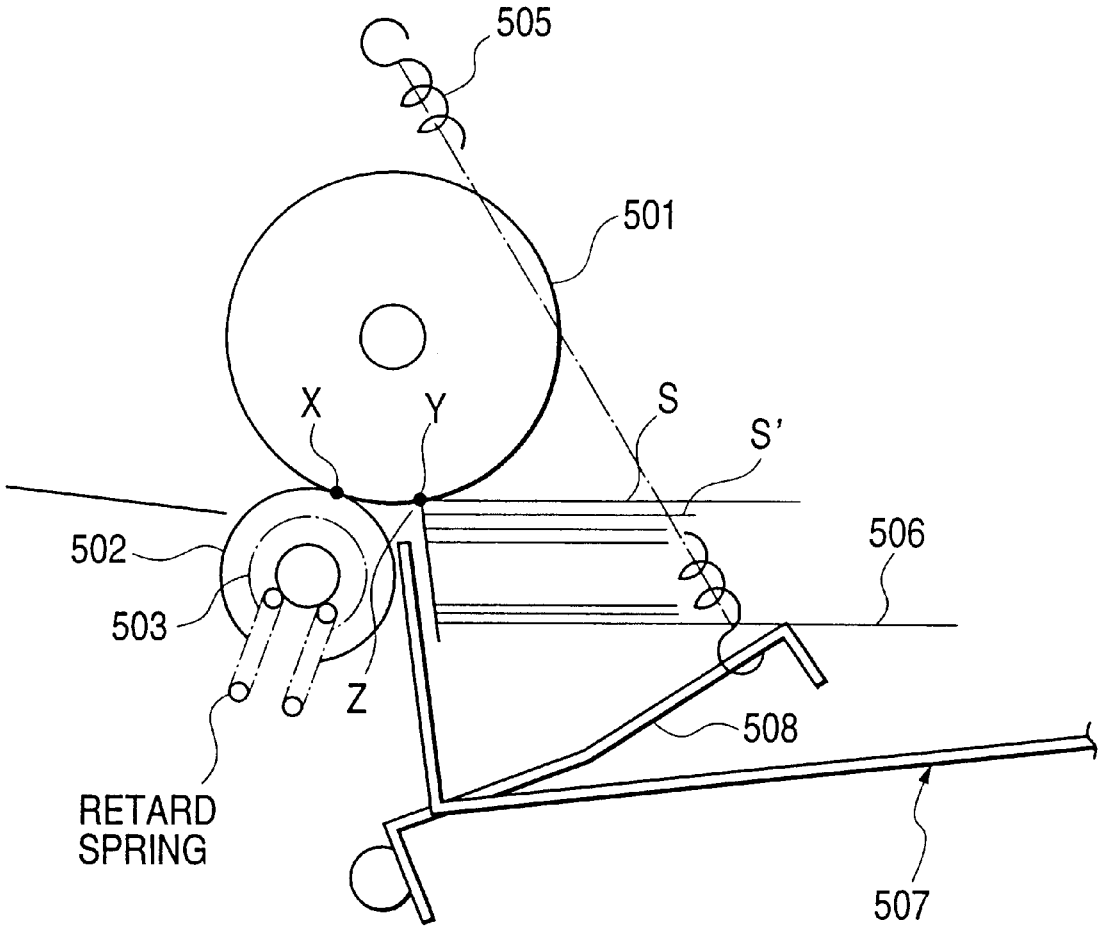
FIG. 17 is a schematic side view showing a first earlier technology.
Figure 18:
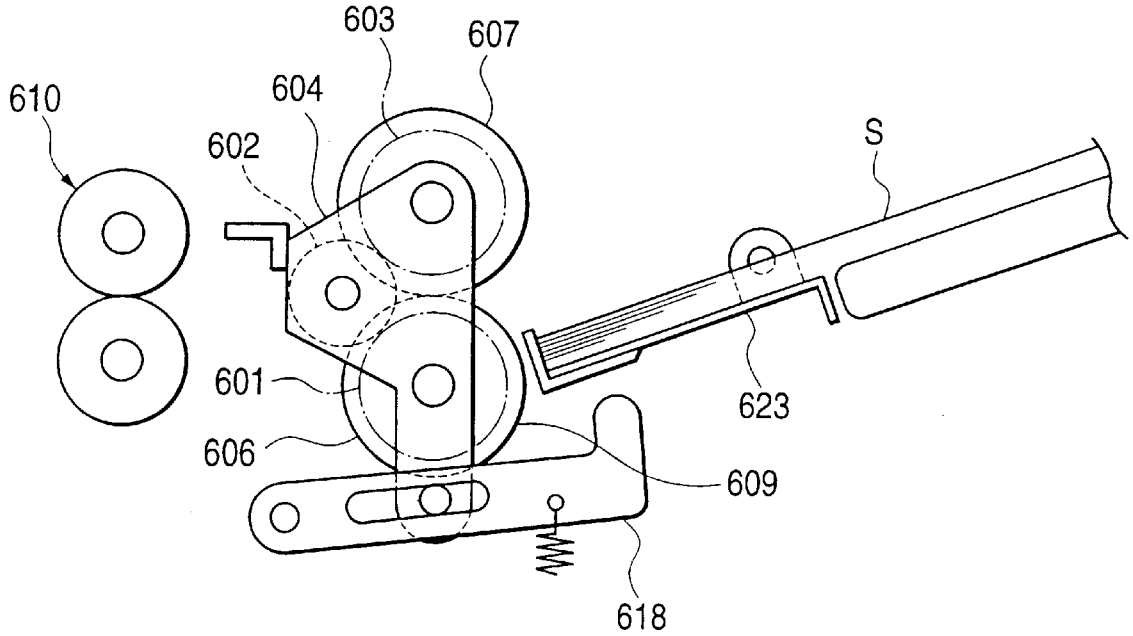
FIG. 18 is a schematic side view showing a second earlier technology (initial state)
Figure 19:
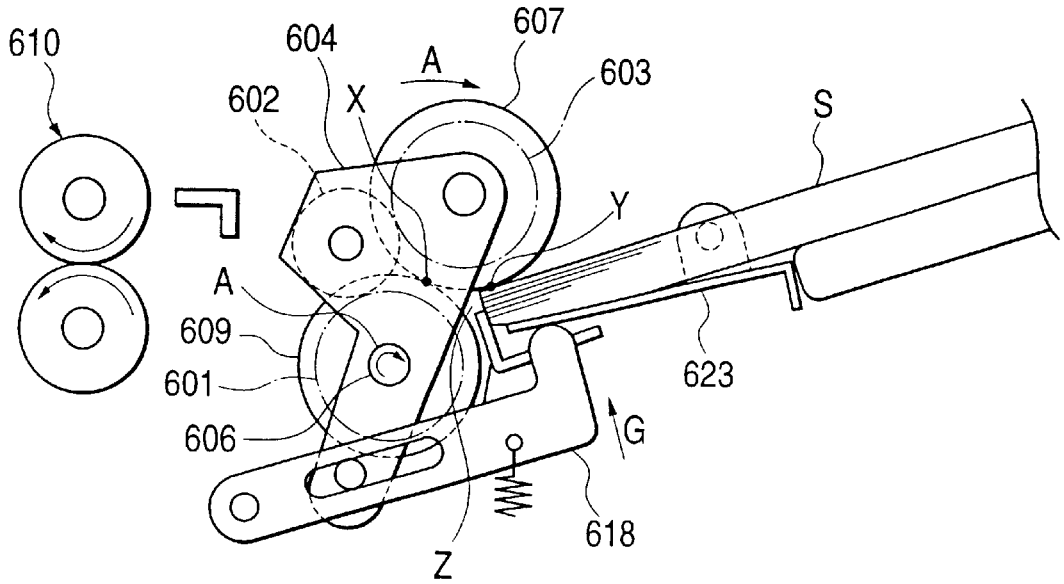
FIG. 19 is a schematic side view showing the second earlier technology (sheet feeding state).

FIGS. 14 and 16 show a relationship between the restoring force Ta of the separating roller and the retard pressure Pb when a sheet having great frictional coefficient between the sheet is fed and separated by a worn sheet feeding roller. As $\mu p$ and $\mu r$, numerical values 0.7 and 1.0 are used, respectively. The other numerical values and expressions are the same as above-mentioned ones.

As shown in FIG. 14 showing the relationship between Ta and Pb in the first earlier technology, in a range of the restoring force Ta<900 g, it can be seen that there is no appropriate sheet feeding area. In this condition, it is very difficult to effect the stable sheet feeding and separating operations. However, in FIG. 16 showing the relationship between Ta and Pb in the present invention, there is the appropriate sheet feeding area. Thus, being greatly influenced by the material of the sheet and wear of the rollers, the stable sheet feeding and separating operations can be performed. The difference in appropriate sheet feeding area between FIG. 14 and FIG. 16 depends upon the presence/absence of the intermediate plate pressure Pa.

Although not shown, a relationship between the restoring force and the retard pressure in the second earlier technology is substantially the same as that in the first earlier technology. The reason is that the sheet feeding pressure of the sheet feeding roller is released from the sheets stacked on the intermediate plate by entering the fed sheet into the nip of the pair of draw rollers in the second earlier technology. This means that the intermediate plate is still urged against the sheet feeding roller in the separating operation.

That is to say, there is the separating operation similar to that in the first earlier technology in which the intermediate plate pressure Pa affects an influence upon the relationship between the restoring force Ta of the separating roller and the retard pressure Pb during the separating operation. Thus, the relationship between the restoring force and the retard pressure in the second earlier technology becomes similar to that in the first earlier technology.

As mentioned above regarding the difference in appropriate sheet feeding area between the earlier technologies and the present invention, the present invention can widen the appropriate sheet feeding area in comparison with the earlier technologies. Thus, the reliable and stable sheet feeding and separating operations can be realized.

Further, since the intermediate plate 70 can be retracted from the sheet feeding roller 51 before the fed sheet S reaches the pair of draw rollers 55 and, in this case, since the restoring force of the separating roller 53 can be applied to the sheet, the sheet(s) double-fed in the sheet feeding operation can surely be restored, thereby achieving high reliable sheet feeding.

When the sheet S is fed by the pair of draw rollers 55, since the intermediate plate 70 is already retracted from the sheet feeding roller 51, the feeding load due to the intermediate plate pressure does not act on the pair of draw rollers 55, thereby improving the service life of the draw rollers.

Further, in the normal state, since the intermediate plate 70 is retracted from the sheet feeding roller 51, when the operator sets the sheet bundle, the setting is not obstructed. When the operator sets the sheets, since he may merely abut the leading end of the sheet bundle against the abutment plate 78, the setting operation is very easy, thereby reducing sheet jamming and skew-feeding due to a poor setting.

Since the interlocking operation between the intermediate plate 70 and the sheet feeding means is controlled by the control gear 80 integrally formed with the cam 80*c* for controlling the intermediate plate 70 and the toothless portion 80*a* or the control gear 101 integrally formed with the cam 101*c* and the nonengagement portions 101*a,* 101*b* and since the sheet feeding timing and the timing for applying and releasing the pressure of the intermediate plate 70 are determined by the phase angle between the toothless portion 80*a* and the cam 80*c* or the phase angle between the nonengagement portions 101*a,* 101*b* and the cam 101*c,* there is few factors for dispersion, thereby achieving the stable sheet feeding and separating operation with low cost.

Further, since the control for rotation and stoppage of the sheet feeding roller 51 and the application and release of the pressure of the intermediate plate 70 can be effected by one ON signal and one OFF signal for the solenoid 69, the control is very easy and the severe control accuracy is not requested.

Furthermore, when the pair of draw rollers 55 are synchronized with the drive shaft 54 of the separating roller 53, since the control is effected by the single draw clutch 60, the apparatus can be simplified, and, since the rollers 55 and the shaft 54 can be driven independently from the rotation of the sheet feeding means, a sheet feeding apparatus having high double-feed preventing ability can be provided.

When the drive transmission between the sheet feeding roller 51 and the separating roller 53 is effected by using the connecting means, by drivingly connecting the shaft 54 of the separating roller 53 to the sheet feeding roller support shaft 52, means such as a one-way clutch for regulating the rotational direction can be omitted, thereby making the sheet feeding apparatus inexpensive; and, by rotatingly driving the sheet feeding roller 51 by the sheet drawn by the pair of draw rollers 55, since the shaft 54 of the separating roller 53 can always be rotated in the restoring direction, the separating ability can be improved.

Further, in the state that the nonengagement portion 101*a* of the control gear 101 is opposed to the sheet feeding drive stage gear 100, although the slight rotational resistance of the torque limiter 62 acts on the sheet feeding roller 51 and the separating roller 53, these rollers can freely be rotated in both directions. Thus, the jammed sheet can be pulled both in the sheet feeding direction and in the opposite direction, thereby improving the sheet jamming treating ability greatly.

Incidentally, in the above-mentioned embodiment and its alteration, while an example that one revolution of the control gear 80 is controlled by the spring clutch 68 is explained, the present invention is not limited to such an example, but, for example, a stepping motor may be used as the sheet feeding motor M2 to control one revolution.

Further, in the above-mentioned embodiment and its alteration, while an example that the sheet feeding means and the intermediate plate 70 are driven by the sheet feeding motor M1 and the pair of draw rollers 55 and the separating roller 53 are driven by the draw motor M2 is explained, the present invention is not limited to such an example, but the driving force may be distributed from motors for driving the photosensitive drum 12 and the fixing unit 22.

Further, in the above-mentioned embodiment and its alteration, while an example that the torque limiter 62 is provided on the separating roller 53 to apply to the separating roller 53 the predetermined torque directing toward the direction opposite to the sheet feeding direction is explained, the present invention is not limited to the torque limiter 62 so long as such torque can be applied to the separating roller 53.

In the above-mentioned embodiment and its alteration, while an example that the present invention is applied to the multisheet feeding porion is explained, of course, the present invention can be applied to a cassette sheet feeding portion or a deck sheet feeding portion.

Lastly, in the above-mentioned embodiment and its alteration, while an example that the sheet feeding apparatus according to the present invention is applied to the copying machine as the image forming apparatus is explained, the present invention is not limited to such an example, but, for example, the present invention can be applied to an image reading apparatus by providing an image reading portion at a downstream side of the sheet feeding apparatus according to the present invention in the sheet feeding direction.

What is claimed is:

1. A sheet feeding apparatus comprising:

movable sheet supporting means for supporting a sheet;

a sheet feeding roller for urging against the sheet supported by said sheet supporting means and rotating in a sheet feeding direction to feed the sheet;

a separating roller opposed to said sheet feeding roller and rotatable in a sheet restoring direction to separate the sheet fed from said sheet feeding roller, wherein said separating roller urges against said sheet feeding roller;

conveying means disposed downstream of a separating portion, in which said sheet feeding roller is in pressure contact with said separating roller, in the sheet feeding direction for conveying the sheet fed from said sheet feeding roller; and pressing and retracting means for moving said sheet supporting means to place the sheet supported by said sheet supporting means into pressure contact with said sheet feeding roller and to release the pressure contact between said sheet feeding roller and the sheet, wherein said pressing and retracting means moves said sheet supporting means to separate the sheet, which has been in pressure contact with said sheet feeding roller, from said sheet feeding roller to release the pressure contact between said sheet feeding roller and the sheet after a leading end of the sheet reaches said separating portion and before the leading end of the sheet reaches said conveying means.

2. A sheet feeding apparatus according to claim 1, wherein said separating roller has torque limiter means for imparting a predetermined torque to said separating roller.

3. A sheet feeding apparatus according to claim 1, wherein said separating roller is driven by a drive source for said conveying means.

4. A sheet feeding apparatus according to claim 1, further comprising:

drive transmitting means for transmitting a rotational driving force to said sheet feeding roller to rotate said sheet feeding roller, said drive transmitting means including a partially toothless gear to which the rotational driving force is imparted and a sheet feeding drive gear engageable with said partially toothless gear for rotating said sheet feeding roller.

5. A sheet feeding apparatus according to claim 4, further comprising:

a sheet feeding roller shaft for supporting said sheet feeding roller; and connecting means for mechanically connecting said sheet feeding roller shaft to a separating roller shaft for rotatably supporting said separating roller to transmit a rotational force transmitted by said drive transmitting means to said separating roller to rotate said sheet feeding roller.

6. A sheet feeding apparatus according to claim 5, wherein said connecting means comprises pulley members attached to said sheet feeding roller shaft and said separating roller shaft.

7. A sheet feeding apparatus according to claim 5, wherein said connecting means comprises a gear train including a connecting gear provided on said sheet feeding roller shaft, a separating roller gear provided on said separating roller shaft, and an idler gear engaged by said connecting gear and said separating roller gear.

8. A sheet feeding apparatus according to claim 4, wherein said pressing and retracting means comprises a cam rotatably integral with said partially toothless gear and a cam follower provided on said sheet supporting means and engageable with and disengageable from said cam, and wherein said cam is rotated by a rotation of said partially toothless gear to be disengaged from and engaged with said cam follower to bring the sheet supported by said sheet supporting means into pressure contact with said sheet feeding roller and release the pressure contact.

9. A sheet feeding apparatus according to claim 8, wherein said pressing and retracting means comprises a rocking spring for imparting an urging force to said sheet supporting means in a direction urging said sheet supporting means against said sheet feeding roller, and wherein when said cam is engaged with said cam follower, the pressure contact between the sheet and said sheet feeding roller is released against the urging force of said rocking spring, and, when said cam is disengaged from said cam follower, the sheet is brought into pressure contact with said sheet feeding roller by the urging force of said rocking spring.

10. A sheet feeding apparatus according to claim 4, wherein said drive transmitting means comprises a stage gear, including first and second sector gears, and two sheet feeding drive gears rotatably integral with said sheet feeding roller, each engageable with a respective sector gear, and wherein rotation of said stage gear transmits a driving force to said two gears rotatable integrally with said sheet feeding roller to a rotating speed of said sheet feeding roller is changed by transmitting a rotation of said stage gear to said sheet feeding drive gears as said sheet feeding roller is rotated.

11. A sheet feeding apparatus according to claim 10, wherein said first sector gear has a small diameter and a small angle and said second sector gear has a large diameter and a large angle, and one of said two sheet feeding drive gears comprises a large diameter gear engaged with said first sector gear, and the other of said two sheet feeding drive gears comprises a small diameter gear engageable with said second sector gear, and wherein when said stage gear is rotated, said first sector gear is engaged with said large diameter gear to rotate said sheet feeding roller at a first feeding speed to thereby feed out the sheet on said sheet supporting means and subsequently said second sector gear is engaged with said small diameter gear to rotate said sheet feeding roller at a second feeding speed higher than the first feeding speed to thereby further feed the fed-out sheet.

12. A sheet feeding apparatus according to claim 11, wherein the second feeding speed is equal to a sheet conveying speed of said conveying means.

13. An image forming apparatus comprising:

movable sheet supporting means for supporting a sheet;

a sheet feeding roller for urging against the sheet supported by said sheet supporting means and rotating in a sheet feeding direction to feed the sheet;

a separating roller opposed to said sheet feeding roller and rotatable in a sheet restoring direction to separate the sheet fed from said sheet feeding roller, wherein said separating roller urges against said sheet feeding roller;

conveying means disposed downstream of a separating portion, in which said sheet feeding roller is in pressure contact with said separating roller, in the sheet feeding direction for conveying the sheet fed from said sheet feeding roller;

image forming means for forming an image on the sheet conveyed by said conveying means; and pressing and retracting means for moving said sheet supporting means to place the sheet supported by said sheet supporting means into pressure contact with said sheet feeding roller and to release the pressure contact between said sheet feeding roller and the sheet, wherein said pressing and retracting means moves said sheet supporting means to separate the sheet, which has been in pressure contact with said sheet feeding roller, from said sheet feeding roller to release the pressure contact between said sheet feeding roller and the sheet after a leading end of the sheet reaches said separating portion and before the leading end of the sheet reaches said conveying means.

14. An image reading apparatus comprising:

movable sheet supporting means for supporting a sheet;

a sheet feeding roller for urging against the sheet supported by said sheet supporting means and rotating in a sheet feeding direction to feed the sheet;

a separating roller opposed to said sheet feeding roller and rotatable in a sheet restoring direction to separate the sheet fed from said sheet feeding roller, wherein said separating roller urges against said sheet feeding roller;

conveying means disposed downstream of a separating portion, in which said sheet feeding roller is in pressure contact with said separating roller, in the sheet feeding direction for conveying the sheet fed from said sheet feeding roller;

image reading means for reading image information on the sheet conveyed by said conveying means; and pressing and retracting means for moving said sheet supporting means to place the sheet supported by said sheet supporting means into pressure contact with said sheet feeding roller and to release the pressure contact between said sheet feeding roller and the sheet, wherein said pressing and retracting means moves said sheet supporting means to separate the sheet, which has been in pressure contact with said sheet feeding roller, from said sheet feeding roller to release the pressure contact between said sheet feeding roller and the sheet after a leading end of the sheet reaches said separating portion and before the leading end of the sheet reaches said conveying means.

* * * * *

UNITED STATES PATENT AND TRADEMARK OFFICE

CERTIFICATE OF CORRECTION

PATENT NO. : 6,354,584 B1
DATED : March 12, 2002
INVENTOR(S) : Takeshi Suga et al.

It is certified that error appears in the above-identified patent and that said Letters Patent is hereby corrected as shown below:

Title page,
Item [57], ABSTRACT,
Line 15, “presser” should read -- pressure --.

Column 3,
Line 13, “thin” should read -- a thin --; and
Line 21, “greater” should read -- a greater --.

Column 4,
Line 35, “a roller,” should read -- a conveying roller, --; and
Line 38, “pressing and a” should read -- a pressing and --.

Column 6,
Line 50, “an” should read -- a --.

Column 8,
Line 45, “an” should read -- a --.

Column 11,
Line 3, “double-feeding certainly.” should read -- double-feeding. --; and
Line 60, “jam” should read -- jamming --.

Column 12,
Line 63, “in” should be deleted.

Column 13,
Line 36, “100 a” should read -- 100a --.

Column 14,
Line 6, “an” should read -- a --.

Column 16,
Line 13, “so” should read -- so as --;
Line 30, “the” should be deleted; and
Line 43, “subjected” should read -- subjected to --.

UNITED STATES PATENT AND TRADEMARK OFFICE

CERTIFICATE OF CORRECTION

PATENT NO. : 6,354,584 B1
DATED : March 12, 2002
INVENTOR(S) : Takeshi Suga et al.

It is certified that error appears in the above-identified patent and that said Letters Patent is hereby corrected as shown below:

Column 17,
Line 18, “draw” should read -- drawn --.

Column 20,
Line 37, “being” should read -- without being --.

Column 23,
Line 61, “engaged” should read -- engageable --.

Signed and Sealed this

First Day of October, 2002

*Attest:*

*Attesting Officer*

JAMES E. ROGAN
*Director of the United States Patent and Trademark Office*